US007749143B2

(12) United States Patent
Webber

(10) Patent No.: US 7,749,143 B2
(45) Date of Patent: Jul. 6, 2010

(54) LEG EXERCISE APPARATUS

(75) Inventor: Randall T. Webber, La Jolla, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 214 days.

(21) Appl. No.: 11/466,581

(22) Filed: Aug. 23, 2006

(65) Prior Publication Data

US 2008/0051265 A1 Feb. 28, 2008

(51) Int. Cl.
*A63B 21/00* (2006.01)
*A63B 21/062* (2006.01)

(52) U.S. Cl. ..... 482/138; 482/100; 482/137

(58) Field of Classification Search ..... 482/79–80, 482/92–94, 97–103, 111–113, 133–139; *A63B 21/00*
See application file for complete search history.

(56) References Cited

U.S. PATENT DOCUMENTS 4,448,412 A 5/1984 Brentham
4,509,746 A 4/1985 Mask
4,627,614 A * 12/1986 de Angeli ..... 482/97
4,763,897 A * 8/1988 Yakata ..... 482/100
5,106,081 A 4/1992 Webb
5,549,533 A 8/1996 Olson et al.
5,554,086 A 9/1996 Habing et al.
5,616,111 A * 4/1997 Randolph ..... 482/133
5,672,143 A * 9/1997 Ish, III ..... 482/99
5,961,428 A 10/1999 Webber
5,980,434 A * 11/1999 Webber ..... 482/100
6,319,178 B1 * 11/2001 Webber ..... 482/100
6,659,919 B2 12/2003 Deola
7,452,311 B2 * 11/2008 Barnes et al. ..... 482/96
2006/0116254 A1 6/2006 Webber et al.
2006/0258517 A1 * 11/2006 Ashley ..... 482/94

OTHER PUBLICATIONS

FL-103 Hamtractor (Seated Leg Curl), Flex Fitness Brochure, 2002.
S110A Standing Leg Curl, Body Masters Brochure, 2002.
CX108 Super Leg Curl, Body Masters Brochure, date unknown.
VLP Leg Press Station, Hoist Fitness Brochure, 2004.

* cited by examiner

*Primary Examiner*—Loan H Thanh
*Assistant Examiner*—Oren Ginsberg
(74) *Attorney, Agent, or Firm*—Procopio, Cory, Hargreaves & Savitch LLP

(57) ABSTRACT

A convertible leg exercise apparatus for performing different leg exercises has a first leg exercise arm pivotally mounted on a frame for rotation about a first pivot axis and a second leg exercise arm pivotally attached to the first arm for rotation about a second pivot axis spaced below the first pivot axis. The second arm pivots about the second pivot axis away from the first arm to perform one leg exercise, while the first and second arms pivot together about the first pivot axis to perform another leg exercise. The second arm may be configured to perform a leg press exercise while the first and second arms rotate together to perform leg extension and leg curl exercises.

55 Claims, 25 Drawing Sheets

LEG EXERCISE APPARATUS

BACKGROUND

1. Field of the Invention

The present invention generally relates to weight lifting exercise machines and is particularly concerned with a leg exercise apparatus or station for such machines.

2. Related Art

The three most widely performed leg exercises are the leg extension, leg curl, and leg press exercise. Between them they cover all of the lower body's major muscle groups. In health clubs, these exercises are generally performed on single function machines, with one machine providing only one of the three types of leg exercise. Leg extension and leg press exercises are generally performed from a seated position, while the leg curl exercise can be performed standing, lying, kneeling, or sifting, depending on the design of the machine.

The leg press is a compound movement exercise, requiring movement of multiple joints, specifically at the knee and hip, and multiple body parts, specifically the upper and lower legs. The leg extension and leg curl are isolation exercises that involve a single joint, the knee, and require movement of a single body part, the lower leg. As a general rule, isolation exercises require less resistive load than compound movement exercises, due to the number of muscle groups that are involved in the exercise. Leg extension and leg curl exercises are often provided on one machine using the same user support and pivoting exercise arm. It is rare for a leg press exercise to be incorporated with the other two leg exercise stations.

Leg extension, leg curl, and leg press exercise stations are also sometimes incorporated in multi-function gyms or exercise machines that have multiple exercise stations to allow a user to perform a wide variety of upper and lower body exercises. Generally, the leg extension and leg curl are performed from the same seat or station while the leg press is performed from a different position or station. Often this is an additional or optional attachment to the main, multi-function gym.

U.S. Pat. No. 4,448,412 of Brentham illustrates a combination leg extension and seated leg curl machine which places the user in an upright, seated position for both exercises. This design has a single leg exercise arm which is equipped with two sets of user engaging pads for engagement during the two different exercises. U.S. Pat. No. 5,106,081 of Webb illustrates a stand-alone leg press machine which has a user engaging foot plate attached to a movable exercise arm.

U.S. Pat. No. 5,549,533 of Olson and U.S. Pat. No. 6,659,919 of Deola each describe a combination leg extension, leg curl, and leg press exercise station. In both machines, a first exercise arm is pivotally attached to the base of the frame at a first pivot connection located at the lower end of the arm. A second exercise arm is pivotally connected to the first exercise arm at a location spaced above the first pivot connection. A user engaging foot plate is attached to the upper end of the first arm in Olson, on a forwardly curved upper end portion of the arm, while user engaging roller pads for leg curl and leg extension exercises are attached to the second arm. Because the first exercise arm protrudes above the level of the seat, the user must step up and over the seat pad to enter or exit the machine, which is awkward. The relative positions of the two exercise arms can make either exercise more difficult. The foot plate can interfere with the user when performing curl exercises using the second exercise arm. When performing leg press exercises, the second arm can fall forward, making it more difficult to return the two arms to the start position.

In Deola, the resistance cable must be attached to one exercise arm to perform leg extensions or leg curls, and must be moved and attached to the other exercise arm for performing leg press exercises.

SUMMARY

The present invention provides a convertible leg press/leg extension exercise apparatus or station which can be used on a stand alone exercise machine or incorporated as a leg station on a multi-function gym. In one embodiment, an exercise machine has a support frame and a convertible leg exercise station mounted on the frame. The leg exercise station comprises a leg extension arm pivotally mounted on the frame for rotation about a first pivot axis, spaced above a ground or floor engaging portion of the frame, and a leg press arm pivotally attached to the leg extension arm for rotation about a second pivot axis which is at a lower elevation than the first pivot axis or spaced forwardly from the first pivot axis, or both. A user engaging foot plate may be configured for movable mounting in the upper end of the leg press arm, and the foot plate is vertically adjustable relative to the leg press arm to accommodate users of different heights. The foot plate is movable between a first position for performing leg press exercises and a second, storage position when leg extension exercises are performed. When the foot plate is moved into the second position, the leg exercise station does not protrude any substantial distance above the first pivot axis.

In one embodiment, a resistance transfer mechanism is secured to the leg exercise station such that no adjustment is needed whether performing leg press, leg extension, or leg curl exercises, and both exercise arms follow a fixed path.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an exercise machine with a combination leg exercise station that allows a user to perform leg extension, leg curl, and leg press exercises using the same exercise station and user support. The leg exercise station can be used on a stand alone machine for leg exercises only, or may be one station of a multi-station gym that can be used for performing various other exercises.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
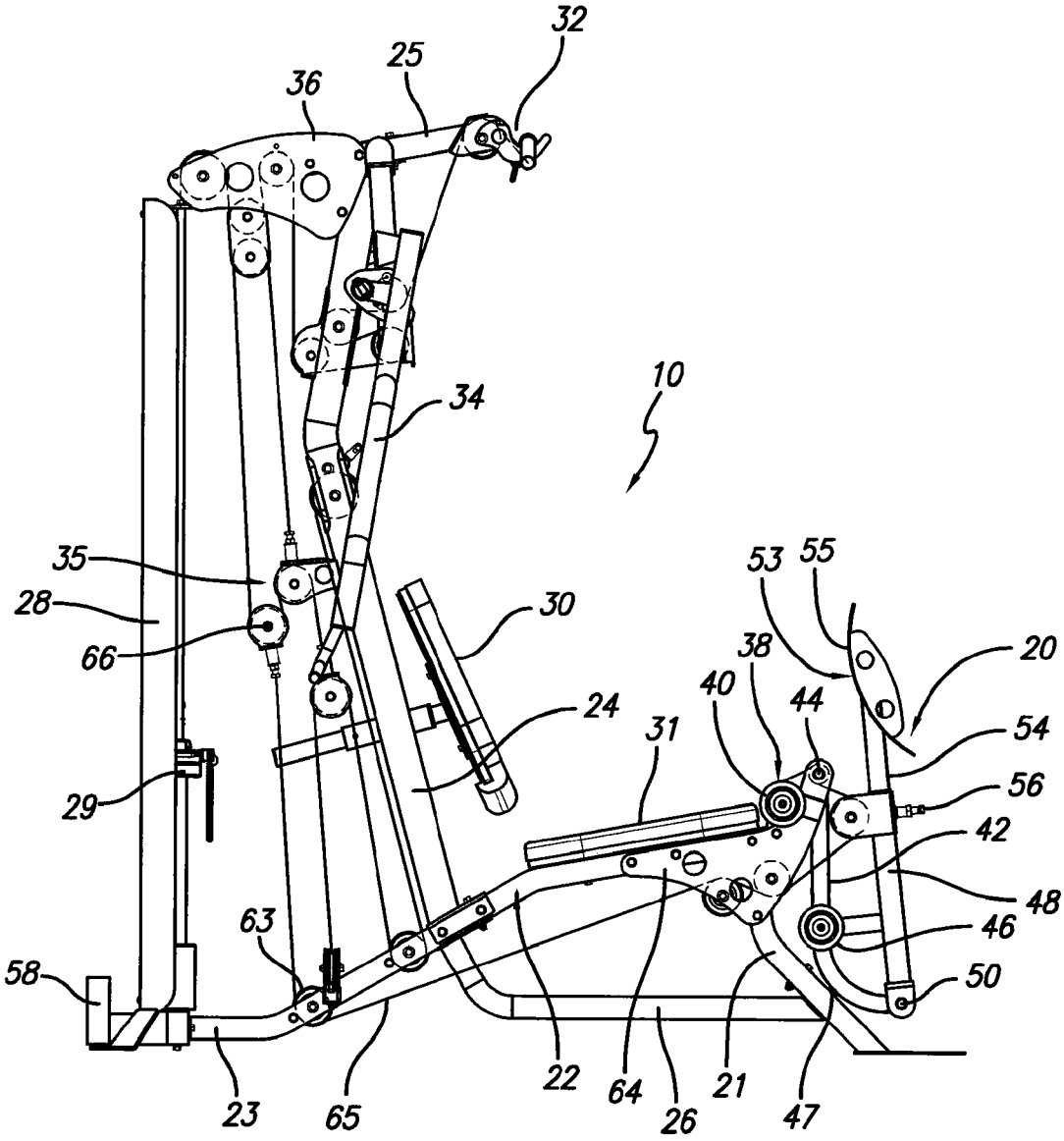
FIG. 1 is a side elevation view of a multi-station exercise machine incorporating a convertible leg exercise station of one embodiment.
Figure 2:
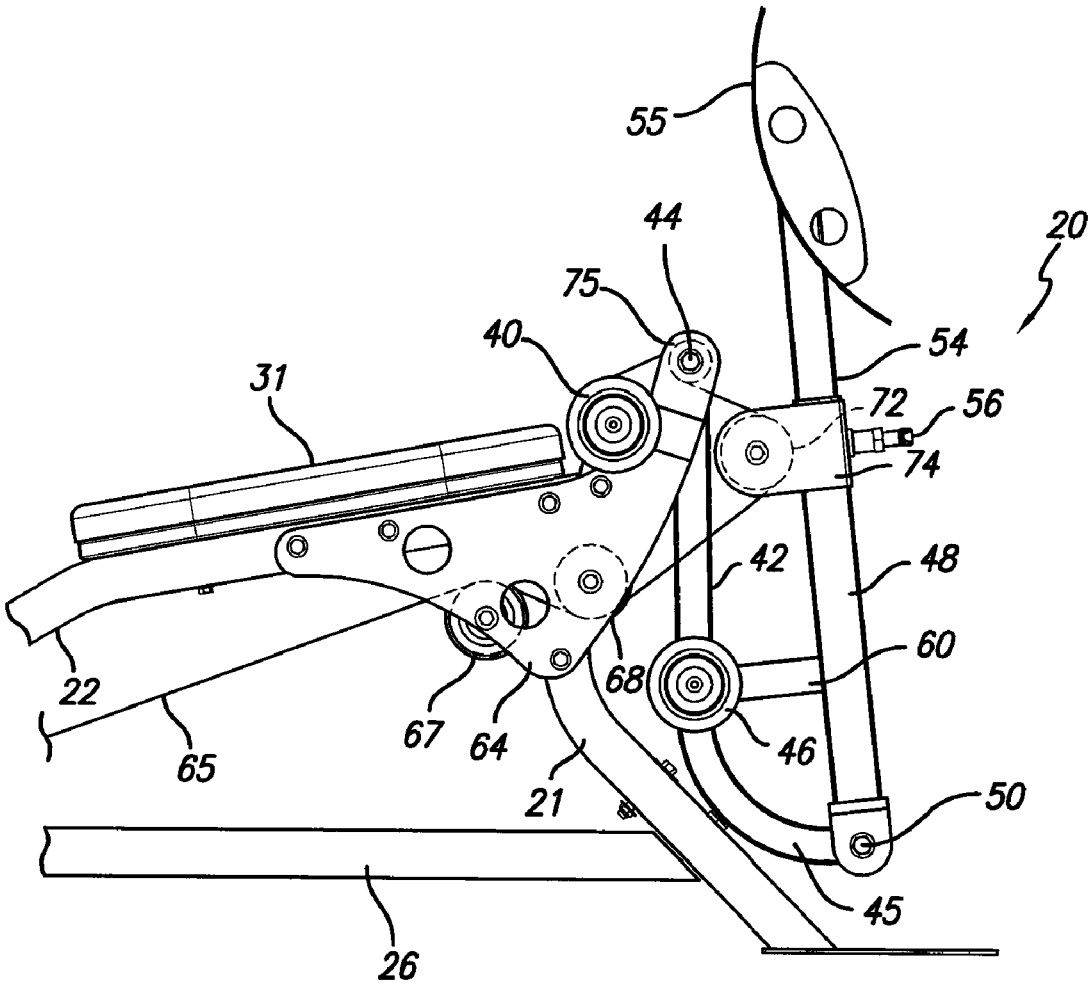
FIG. 2 is an enlarged side elevation view of the convertible leg exercise station of FIG. 1 illustrating the start position of a leg press exercise.
Figure 3:
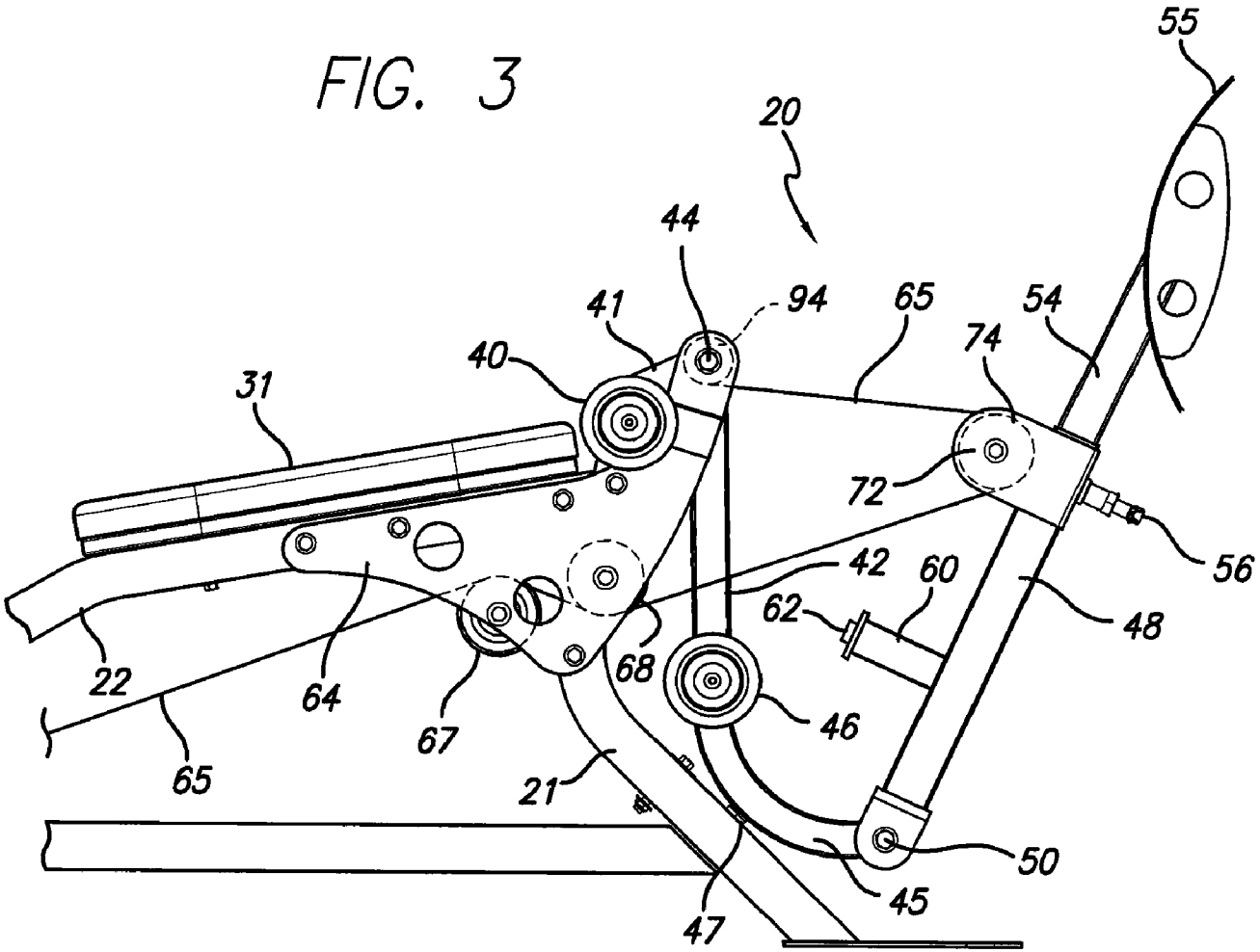
FIG. 3 is a side elevation view similar to FIG. 1 illustrating the finish position for a leg press exercise.
Figure 4:
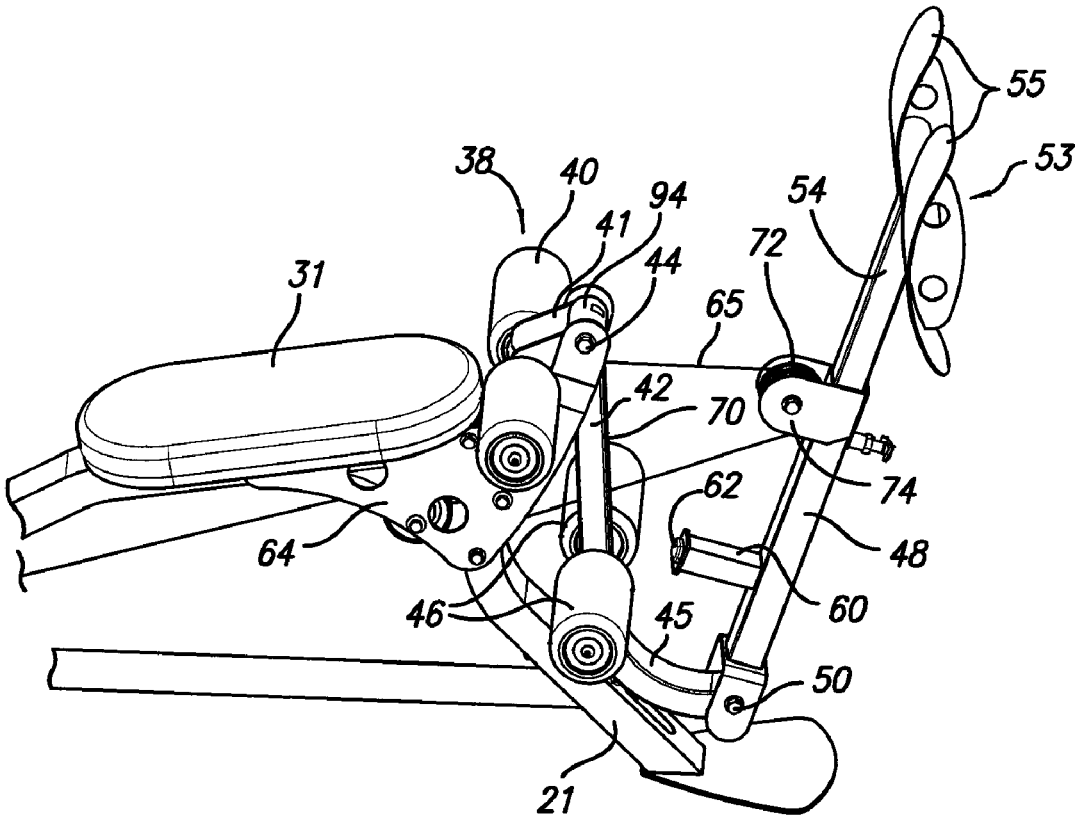
FIG. 4 is a rear perspective view illustrating the finish position of FIG. 3.
Figure 5:
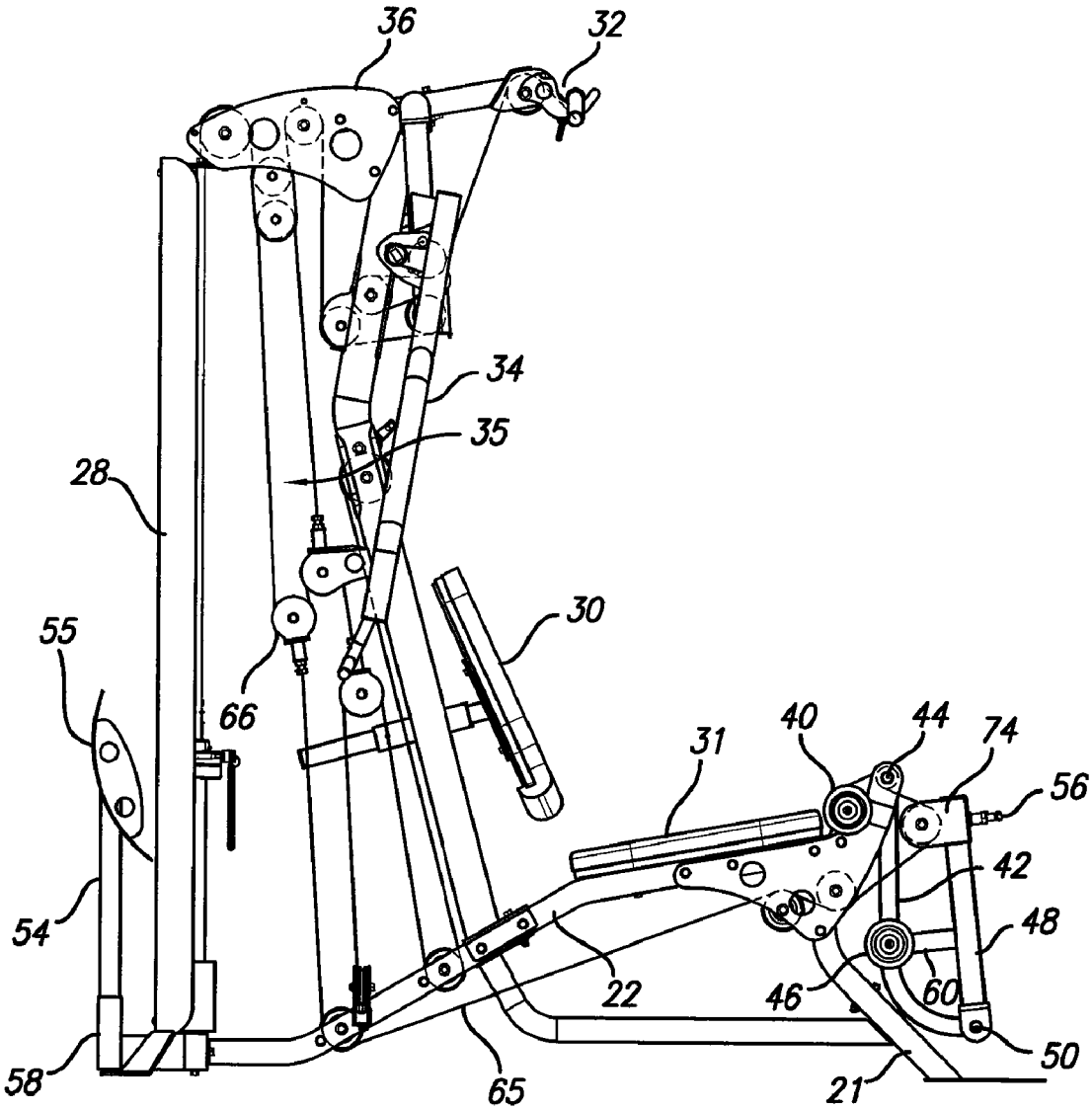
FIG. 5 is a side elevation view of the machine of FIG. 1 with the leg press foot plate removed from the leg exercise station and the arms in a start position for a leg extension or standing curl exercise.
Figure 6:
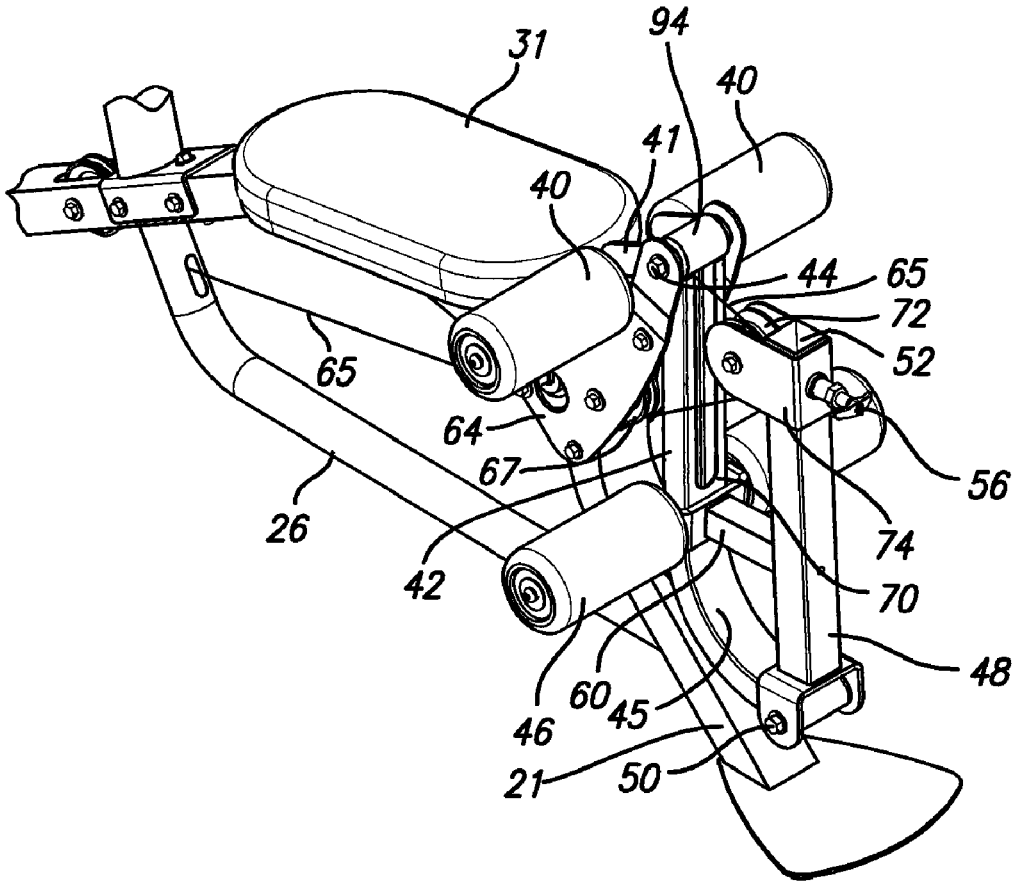
FIG. 6 is a front perspective view of the leg exercise station of FIG. 5 in the start position for a leg extension or standing curl exercise.
Figure 7:
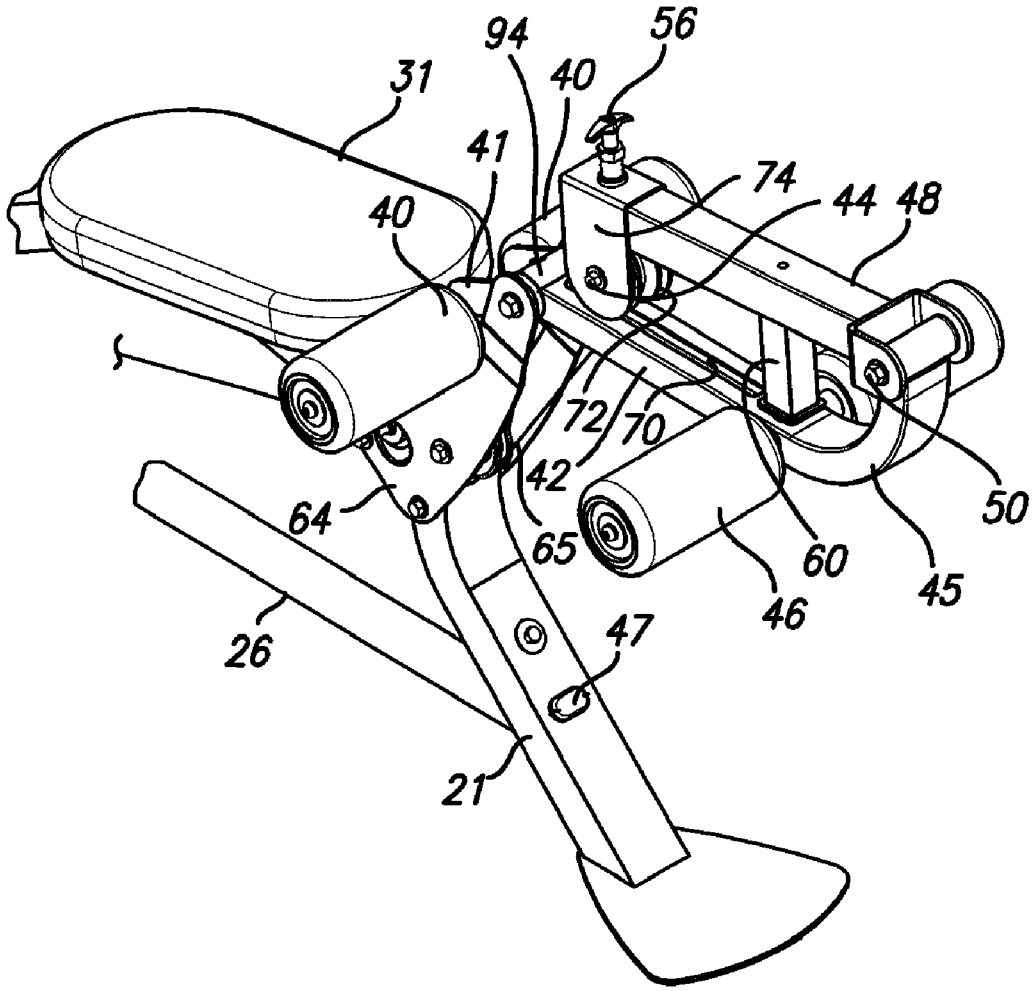
FIG. 7 is a perspective view similar to FIG. 6 illustrating a finish position for a leg extension or standing curl exercise.

FIG. 1 illustrates a multi-station exercise machine or gym 10 including a first embodiment of a combination leg exercise station 20, while FIGS. 2 to 7 illustrate the leg exercise station 20 in various different exercise positions. FIGS. 2 to 4 illustrate the start and finish positions for a leg press exercise, while FIGS. 5 to 7 illustrate start and finish positions for a leg extension or leg curl exercise. The machine 10 has a main frame with a floor engaging base support 22, a generally upright portion 24, a top strut 25, and a lower strut 26. The base support 22 has ground or floor engaging portions, specifically rear support portion 23 and the lower end of front support leg 21. A vertical weight stack support housing 28 is located to the rear of upright portion 24 and supports an adjustable weight stack 29 (only part of which is shown in FIG. 1). An adjustable back pad 30 is mounted on the upright portion 24 of the frame above the seat pad support, and a seat pad 31 is mounted on a raised part of the support 22 in front of the upright strut and back pad, for supporting a user in a seated exercise position.

The leg exercise station 20 is mounted at the forward end of the seat support, and various other exercise stations are mounted at other locations on the frame. Any combination of exercise stations may be provided on machine 10 in addition to leg exercise station 20. The illustrated multi-station gym or machine 10 includes a pull down station 32 and an exercise arm station 34. A cable and pulley assembly 35 connects a weight stack in housing 28 to the various exercise stations. Upper mounting plates 36 join the upper end of the weight stack housing 28 to the upright portion 24 and the strut 25 of the main frame, and also serve as a mount for various components, including pulleys of the cable and pulley assembly 35.

A swiveling thigh support device 38 is mounted on base support 22 between the forward end of seat pad 31 and the leg exercise station 20. This device has roller pads 40 on a pivoting support 41 (see FIG. 4) movable between a lower position as illustrated in FIG. 1 in which the pads engage below the user's knees to provide support during a seated exercise, and an upwardly pivoted position in which the pads 40 engage above the user's knee during a standing exercise.

The combination leg exercise station 20 has a first arm 42 pivotally attached to the frame at a location adjacent its upper end for a rotation about a first pivot axis 44 in front of seat pad 30. The pivot connection between arm 42 and the frame is enclosed in a pivot housing 94 (see FIG. 4). Ann 42 depends downwardly from the pivot axis in front of the main frame. The arm 42 has a forwardly curving section 45 extending up to its second end, and user engaging roller pads 46 are mounted above curving section 45. The roller pads 46 are designed to engage the user's legs when performing leg extension or leg curl exercises. A bumper pad 47 is provided on a forwardly inclined portion of front support leg 21 facing the leg exercise station 20 to support the exercise arm 42 in a start or rest position, as illustrated in FIG. 1.

A second exercise arm 48 has a first end pivotally mounted on the second end of the first arm 42 for rotation about a second pivot axis 50, and extends upwardly in front of the first exercise arm 42. Arm 48 has an open upper end 52 (see FIG. 6) for telescopically receiving a removable foot plate attachment 53. The foot plate attachment comprises a pair of user engaging foot plates 55 on a support post 54 which engages in the open upper end 52 of arm 48. It will be understood that the foot plates 55 may be replaced by a single foot plate or other foot engaging member or members for engagement by both feet in alternative embodiments. FIGS. 1 to 4 illustrate the user engaging foot plate secured in arm 48 in a first position for performing leg press exercises. The post 54 has a series of holes for selectively receiving a releasable pull pin 56 to secure the foot plate 55 at a desired height. When the foot plate is not in use, it can be completely removed from arm 48 and inserted in the open upper end of a support post 58 at the rear of the machine, in a second, storage position as illustrated in FIG. 5. A stop or stand-off post 60 with a resilient bumper pad 62 at its free end (see FIG. 4) extends rearwardly from arm 48, and engages the first arm 42 when the second arm is in the start or rest position of FIGS. 1 and 2, and also when leg extension or leg curl exercises are performed, as in FIGS. 5 to 7.

Although the foot engaging member is removably mounted in arm 48 in the illustrated embodiment, it may alternatively be pivotably attached to arm 48 so that it can fold down out of the way. The foot engaging member in this alternative embodiment is folded up into a first position for performing leg press exercises, and folded down into a second, storage position when the leg exercise station is used to perform leg exercises or leg curls.

A resistance transfer mechanism is provided between the leg exercise station 20 and the weight stack. In the illustrated embodiment, the resistance transfer mechanism is a cable and pulley linkage, but other types of resistance transfer mechanisms may be used in alternative embodiments. Details of the cable path and pulleys which would normally be hidden behind mounting plates are revealed in FIGS. 1 to 3 and 5 for explanation purposes. The actual pulley mounts and cable paths can be seen more clearly in the perspective views of FIGS. 4, 6 and 7. A pair of spaced pulley mounting plates 64 are secured to base support 22 and extend beneath seat pad 31 and upwardly in front of the seat pad. The pivot connection for the first arm 42 of the leg exercise station and the pivoting support 41 for pads 40 are coaxially mounted between the upper ends of plates 64, so that they both pivot about axis 44 as best seen in FIGS. 4, 6 and 7. A load-bearing cable 65 providing exercise resistance to the leg station is linked to the weight stack via floating pulley 66. Cable 65 extends around pulley 63 on frame base support 22, and is reeved around first and second pulleys 67,68 mounted between the plates 64 below the seat pad. The cable then extends through a slot 70 on the first arm 42, and is reeved around a third pulley 72 mounted in a bracket 74 located behind the upper end of arm 48 (see FIG. 4). Finally, the cable 65 passes back through slot 70, as seen in FIG. 6, and is attached to the arm 42 to provide resistance to movement of both the first and second arms. The cable 65 is attached to arm 42 by reeving partially around the pivot housing 94, and then anchoring the cable to the housing at a location 75 above the pivot axis 44, as seen in FIG. 2. This eliminates the need for a swiveling attachment at the cable anchor to prevent the cable from flexing at its termination point during performance of an exercise involving the second or leg press arm 48. Although the cable 65 is reeved around two pulleys 67, 68 on the base support 22 of the main frame in the illustrated embodiment, it may be reeved around a single pulley in an alternative embodiment, eliminating one of the pulleys 67,68.

Operation of the leg exercise station 20 to perform a leg press exercise is illustrated in FIGS. 1 to 4. FIGS. 1 and 2 illustrate the station 20 in a start or rest position. The foot plate 55 is mounted and secured at a desired height in the upper end of the second or leg press arm 48. The first arm 42 is in a rest position against the stop pad 47 of the main frame, while the second arm 48 is positioned by gravity with stand-off post 60 against the first arm. The user sits on seat pad 31 with their feet engaging foot plate 55, and pushes the foot plate forwardly and away from their body. The second arm 48 pivots forwardly about pivot axis 50, moving away from arm 42 as illustrated in FIGS. 3 and 4. At the same time, both lengths of cable 65 that extend out from the pulley 72 mounted on the second arm are pulled and extended from the forward end of the frame as illustrated in FIG. 3, lifting the selected weights in the weight stack. FIGS. 3 and 4 illustrate the leg press arm 48 pivoted forward and extended away from the first arm in a finish position for a leg press exercise. On release, the second arm is pulled back towards the first arm by the exercise resistance.

FIGS. 5 to 7 illustrate operation of the leg exercise station 20 to perform a leg extension or standing leg curl. Prior to performing this exercise, the foot plate 55 is removed from the second arm 48, and can be safely stowed out of the way in support post 58 at the rear of the machine, as illustrated in FIG. 5. FIGS. 5 and 6 illustrate the starting position for a leg extension or leg curl, in which the first arm rests against the front portion of the base support 22 and the second arm rests against the first arm. In order to perform a leg extension, the user sits on seat pad 31 with their legs engaging behind pads 46 and feet facing forwards, and pushes their lower legs forwards from a bent to a straight position. The upper, pivoting pads 40 are in the lower position of FIG. 6 engaging under the user's knees during this exercise. In order to perform a leg curl, the user stands facing the rear of the machine in front of seat pad 31, with pads 40 rotated upwards to rest against the front of the user's thighs, and the user's lower legs engaging behind pads 46. They then bend alternate legs rearward, pushing the exercise arm 42 forwards.

In either case, whether performing leg extensions or leg curls, the exercise arms 42 and 48 are rotated together about pivot axis 44 from the rest or start position of FIGS. 5 and 6 into the forwardly extended finish position of FIG. 7. The second arm 48 travels along with the first arm 42 as the first arm pivots about pivot axis 44, and only the lower length of cable 65 is pulled or extended. It can be seen by comparing FIGS. 4 and 7 that the leg press, which is a compound exercise, pulls double the amount of cable to the leg extension/leg curl exercise, which is an isolation movement. In other words, movement of the second arm pulls more cable which in turn creates greater exercise resistance than movement of the first arm, as is appropriate for compound exercises.

In the finish position for a leg extension exercise, the leg exercise station is completely spaced from a user support area above seat pad 31 where the user's torso is located, as can be seen in FIG. 7. Therefore, by providing a removable foot plate, the risk of such a component intruding on the user support area during performance of an exercise is reduced. The mounting of the leg press arm in front of the leg extension/leg curl arm and pivoting of this arm at a location below the pivot connection of the first arm also places the user engaging foot plate forward of the leg extension arm and the user engaging pads on that arm, which is the proper orientation of the two arms. Since the leg press arm (without the foot plate) moves with the first or leg extension arm during leg extensions and leg curls, extra weight is added to the leg extension/leg curl exercises. The extra weight adds exercise resistance rather than acting as a counter-balance to the exercise movement, since the second arm lies on the first arm during the movement as the first arm swings upward. Gravity always aids the first arm in returning to the original exercise position at the end of an exercise movement.

It will be understood that the exercise machine 10 of FIG. 1 is only one possible example of a machine on which the convertible leg exercise station 20 may be mounted. This station may alternatively be pivotally mounted at appropriate locations on the frames of exercise machines of different design from the illustrated machine, and linked to the exercise resistance in a similar manner to that shown in the drawings.

FIGS. 8 to 13 illustrate a multi-station exercise machine 80 with a modified combination leg exercise station 82. In the embodiment of FIGS. 8 to 13, the resistance transfer mechanism is a load-bearing cable 84 which provides resistance to the convertible leg station 82 but cable 84 attaches to the main frame instead of the first exercise arm as in the previous embodiment. Additionally, lower roller pads 85 for engagement by the user when performing leg extensions or leg curls are transversely mounted on a standoff 86 attached to the second or leg press arm 48, rather than on the first arm 42 as in the previous embodiment. Other parts of the machine 80 are identical to those of FIGS. 1 to 7, and like reference numerals have been used for like parts as appropriate.

The load-bearing cable 84 of this embodiment follows a path from floating pulley 66, around lower pulley 63, through a slot 87 (FIG. 13) in lower strut 26, and around one or more pulleys 67,68 on the plates 64 attached to the main frame. Cable 84 then extends through slot 70 on the first leg 42, around the pulley 72 on the second arm 48, and then back through slot 70, as in the first embodiment. The end of cable 84 then attaches to a swiveling connection 88 on the front of the main frame. Swiveling connection 88 is secured between plates 64, as best seen in FIG. 13, and reduces or eliminates the risk of cable 84 flexing at its termination point as the arms are rotated during exercise movements.

The cable arrangement of FIGS. 8 to 13 provides resistance to movement of both the first arm when performing a leg extension or leg curl and the second arm when performing a leg press exercise, without requiring any adjustment of the cable attachment. The resistance to both exercise arms is provided by a single cable and a single movable pulley 72, as in the first embodiment. However, unlike the first embodiment, two lengths of cable are pulled during each type of leg exercise, as explained in more detail below.

Figure 10:
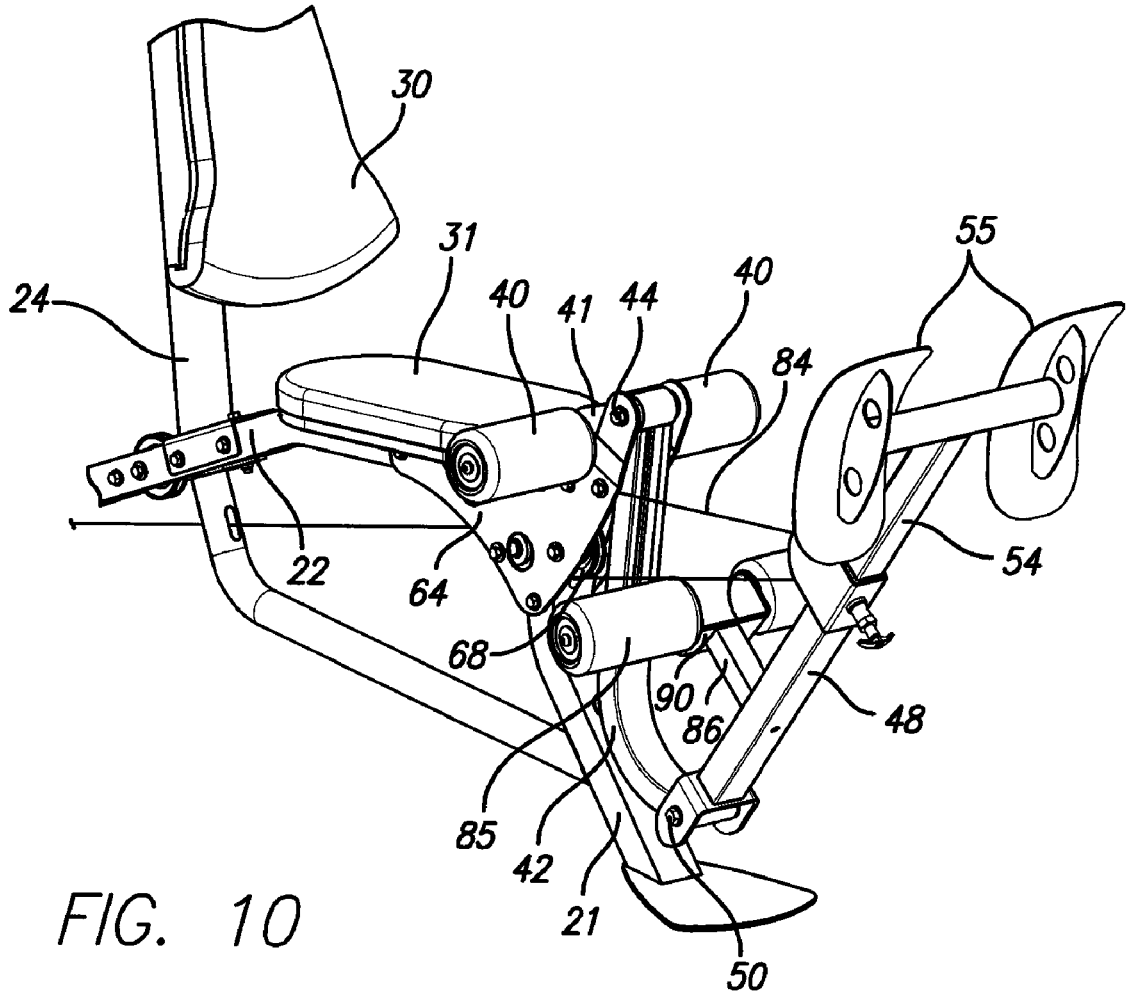
FIG. 10 is a front perspective view of the leg exercise station in the finish position of FIG. 9.
Figure 12:
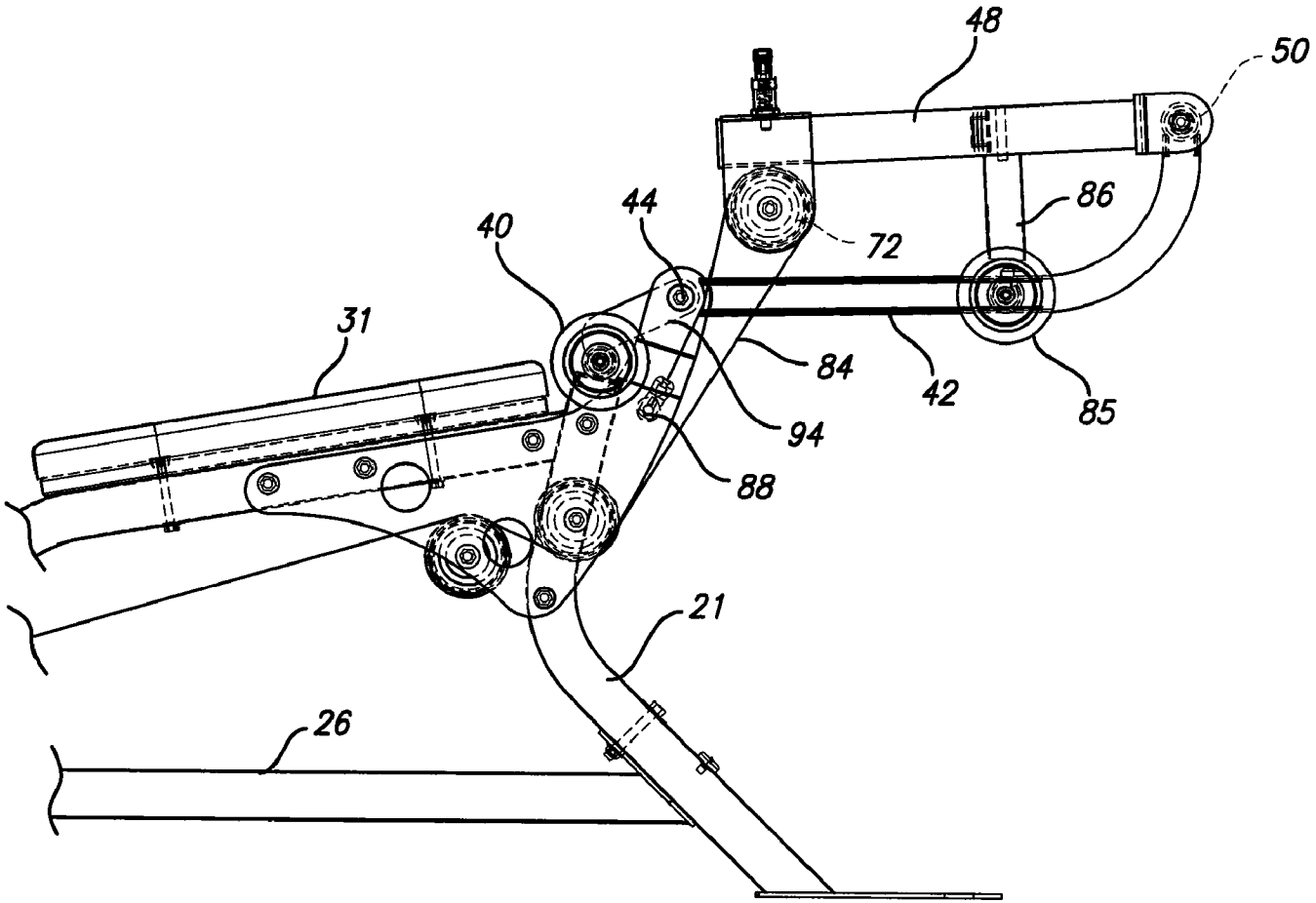
FIG. 12 is a side elevation view similar to FIG. 11 illustrating a finish position for a leg extension or leg curl exercise.
Figure 13:
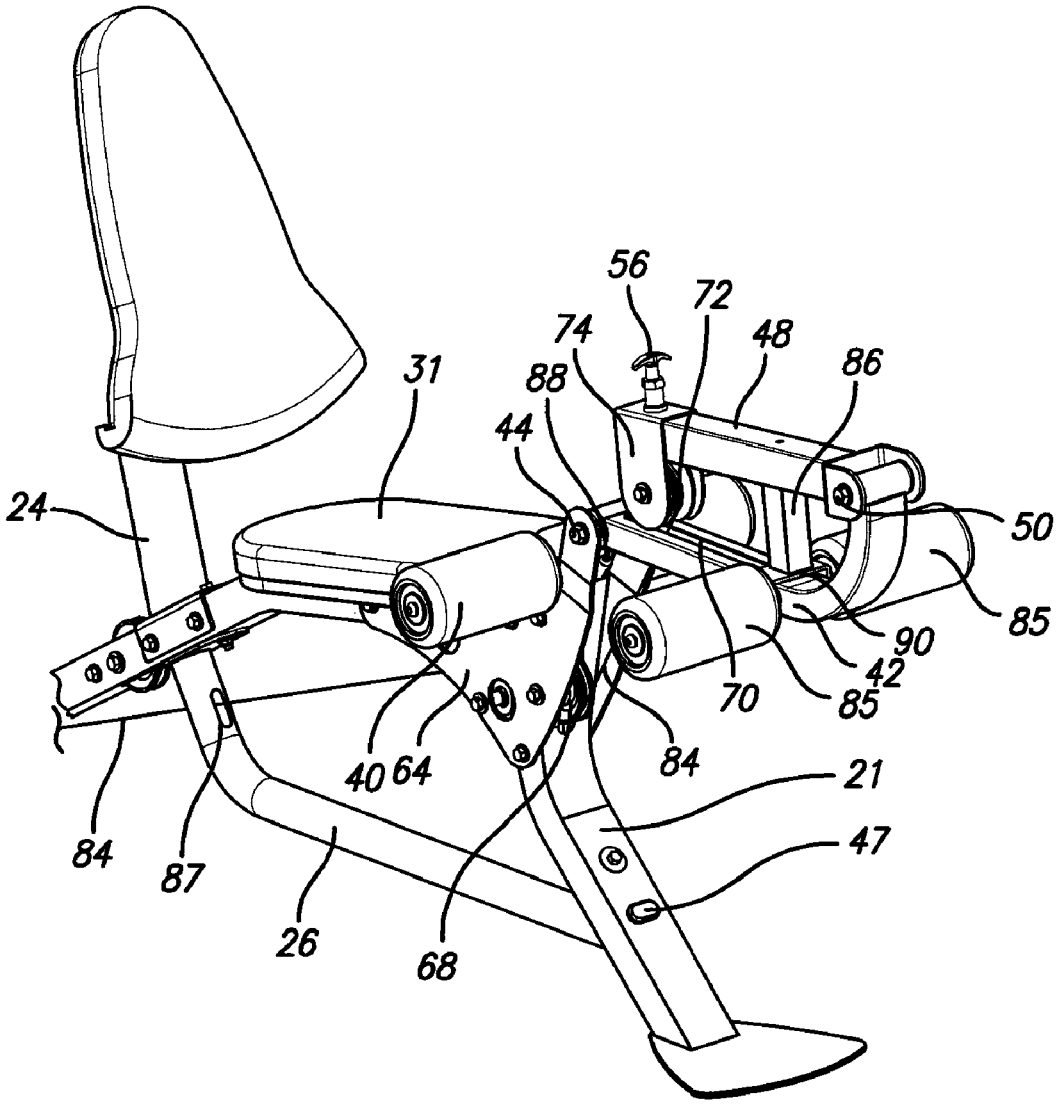
FIG. 13 is a front perspective view of the leg exercise station in the position of FIG. 12.

The lower, leg engaging roller pads 85 are rotatably mounted on opposite sides of a U-shaped mounting bracket 90 which is secured to the end of standoff 86 at its center, as illustrated in FIGS. 10 and 13. This means that when the second arm 48 is positioned against the first arm, the bracket 90 engages over arm 42 with the roller pads 85 positioned on opposite sides of the arm, as in FIGS. 8 and 11 to 13, with the central portion of bracket 90 resting against bumper pad 92 on the first arm 42.

Figure 8:
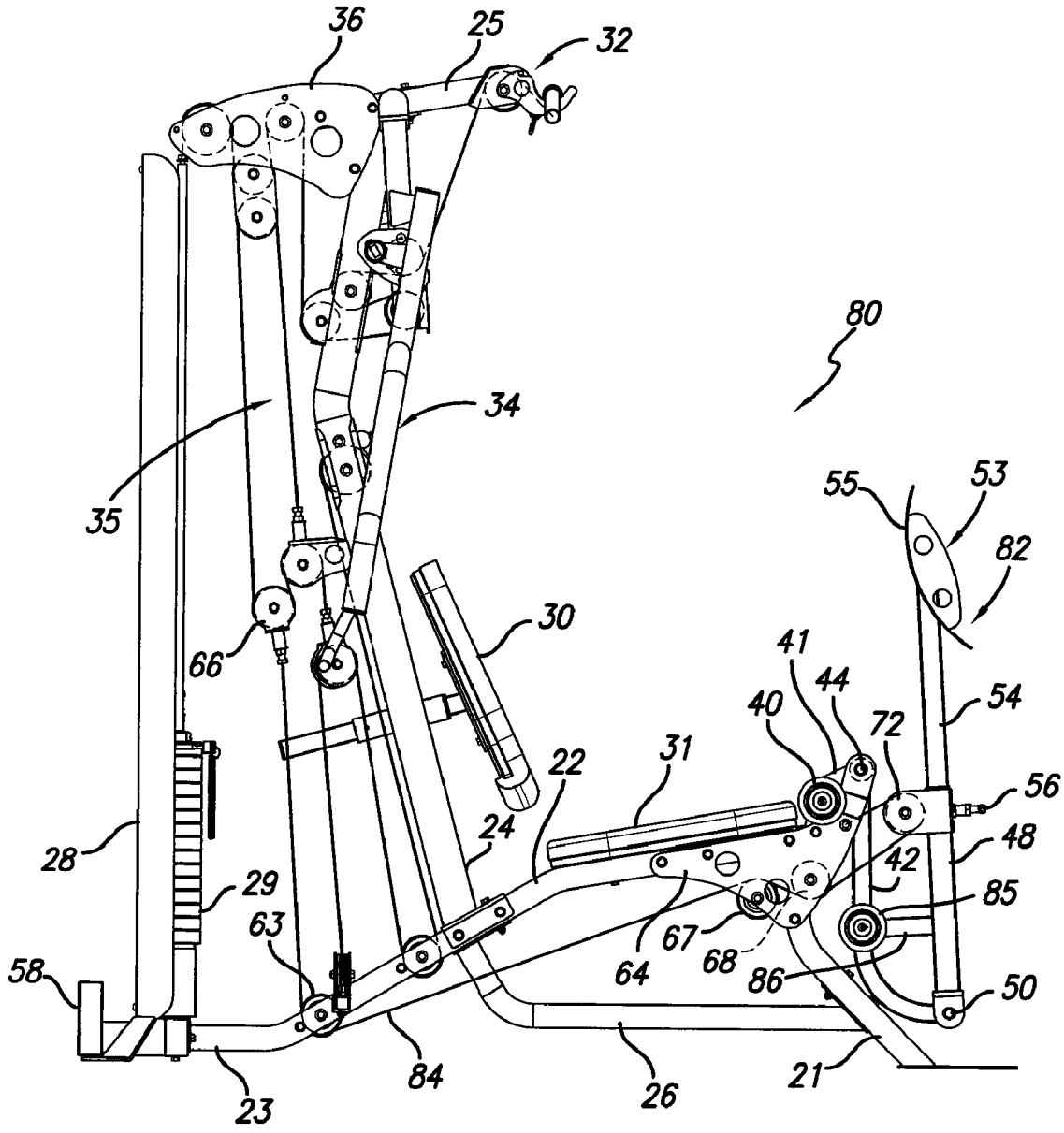
FIG. 8 is a side elevation view of a multi-station exercise machine with a convertible leg exercise station having a different cabling arrangement from the first embodiment, illustrating a start position for a leg press exercise.
Figure 9:
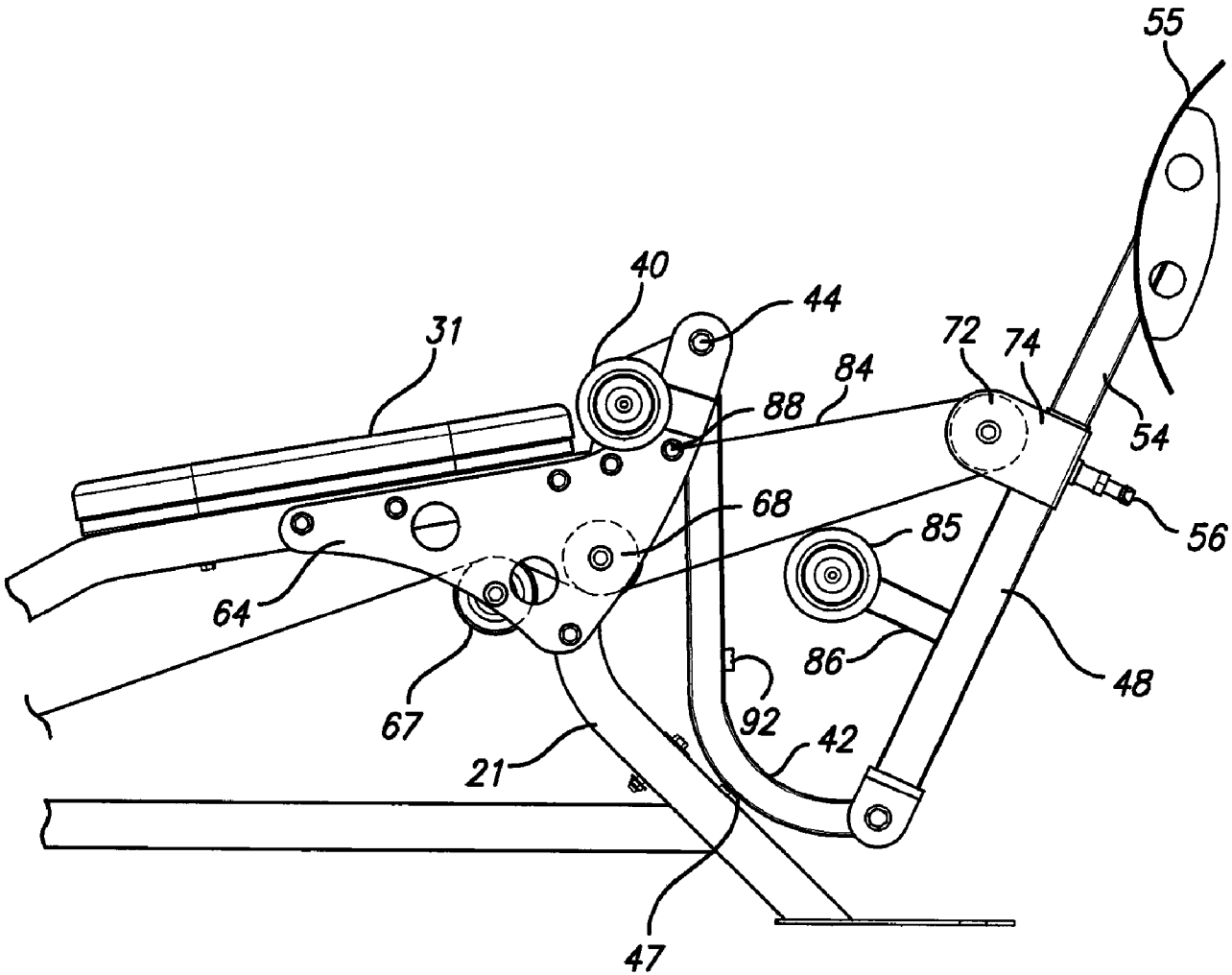
FIG. 9 illustrates the leg exercise station in a finish position for a leg press exercise.

FIG. 8 illustrates the leg exercise station 82 in a start position for a leg press exercise, with the first arm 42 up against the front end of the main frame and the second arm 48 positioned against the first arm with the roller pads 85 positioned on each side of the arm 42. The foot plate attachment 53 is secured in arm 48 with the foot plate 55 at the desired height. The user places their feet against the foot plate 55 and pushes away from their body, rotating the second arm 48 about the lower pivot 50. FIGS. 9 and 10 illustrate the finish position of a leg press exercise. It can be seen that two lengths of cable 84 are pulled to extend the arm 48 away from the front end of the exercise machine when performing this exercise.

Figure 11:
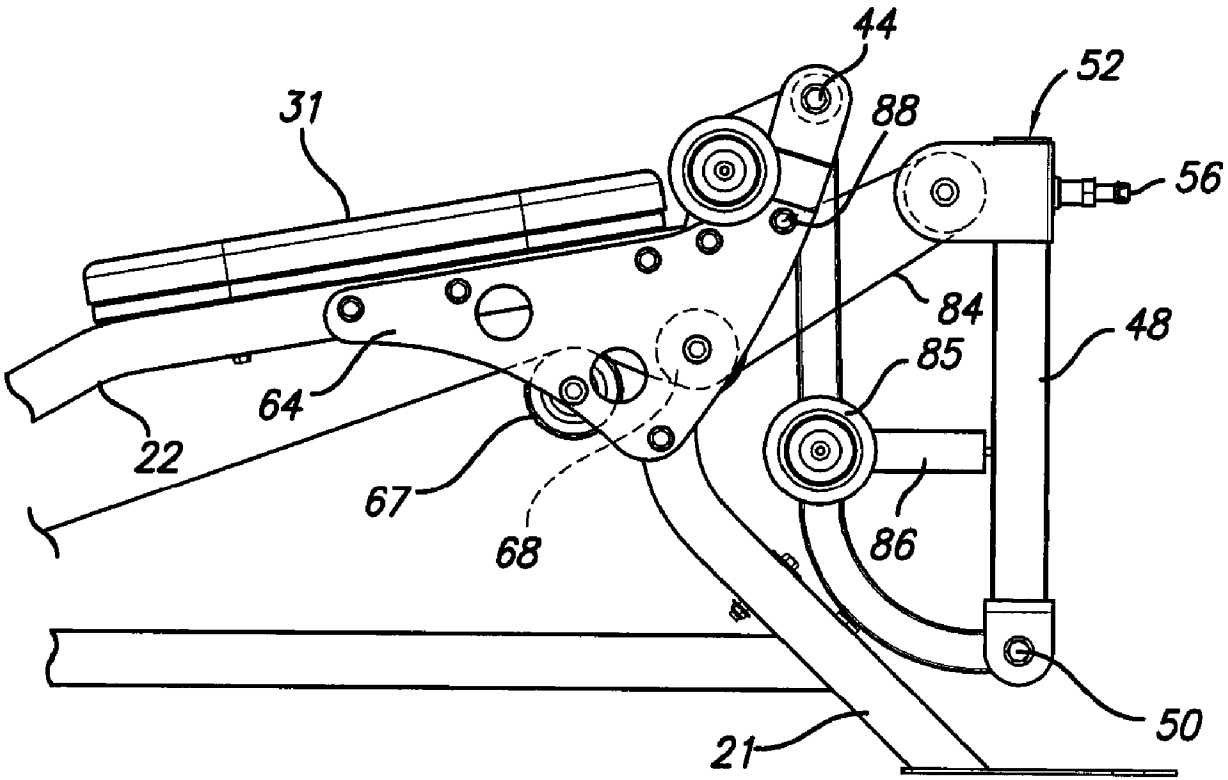
FIG. 11 is a side elevation view of the leg exercise station of FIGS. 8 to 10 in a start position for a leg extension or leg curl exercise.

FIG. 11 illustrates the leg exercise station 82 in a start position for a leg extension or leg curl exercise. The arms 42 and 48 are in the same start position as FIG. 8, and the foot plate 55 and foot plate support post 54 are removed from the arm 48 and placed out of the way in the storage post 58 at the rear of the machine, as in the previous embodiment. The user engages the lower roller pads 85 either from a seated position when performing a leg extension or a standing, rearward facing position when performing a leg curl, and pushes the roller pads away from the front end of the machine. This rotates both arms 42 and 48 upwardly about the upper pivot axis 44 into the finish position illustrated in FIGS. 12 and 13. As the two arms swing upward together during a leg extension or leg curl, the fact that the resistance cable 84 terminates on the main frame causes the upper length of cable 84 reeved around pulley 72 to be pulled slightly, and also causes the lower length of cable 84 extending from pulley 68 to pulley 72 to be pulled or extended by a greater distance than the upper length of cable, as can be seen in FIG. 12. The swiveling connection 88 to the main frame allows the cable 84 to be angled upward with the arms until it contacts the pivot housing 94, where it wraps partially around the housing, pulling additional cable length. This is best illustrated in FIG. 12.

It can be seen by comparison of FIGS. 7 and 12 that more cable is pulled when performing a leg extension or leg curl than in the previous embodiment. Only the lower length of cable is pulled in FIG. 7. In FIG. 12, approximately the same amount of the lower cable length is pulled, in addition to pulling an amount of the upper length cable. Since additional cable is pulled in this embodiment, there is increased resistance during performance of a leg extension or leg curl. However, the leg press exercise still pulls more cable and involves greater resistance than a leg extension or leg curl, as can be seen by comparison of the finish positions for these exercises in FIGS. 9 and 12.

Although the single load-bearing cable 65 or 84 of the embodiments described above provides resistance for exercises performed on the leg exercise station only, it may alternatively continue on to provide resistance for additional exercises. For example, the single cable in FIGS. 1 to 13 may be reeved around a pulley mounted at the top of exercise arm 42 to provide additional exercises, for example with a suitable anchor for securing hand held attachments to the cable, or lengthening of the cable to extend on to other types of exercise station.

Each of the embodiments of FIGS. 1 to 13 allows proper exercise resistance to be provided to both exercise arms with only one cable and one movable pulley. In FIGS. 1 to 7, one length of cable is pulled during a leg extension or leg curl exercise, and two lengths of cable are pulled during a leg press exercise. In FIGS. 8 to 13, two lengths of cable are pulled in each type of exercise, but a smaller amount of cable is pulled in leg extension and leg curl exercises.

FIGS. 14 to 19 illustrate a multi-station exercise machine 100 with a modified combination leg exercise station 110 and a modified, dual cabling arrangement linking exercise station 110 to the exercise resistance. In the embodiment of FIGS. 14 to 19, a first load bearing cable 112 provides resistance to modified leg press arm 114 while a second load bearing cable 115 provides resistance to a modified leg extension/leg curl arm 116. In this embodiment, the cable and pulley linkage 118 from the weight stack to the various exercise stations is modified to provide for two load bearing cables 112 and 115 to the leg exercise station. Other parts of the machine 100 are identical to those of FIGS. 1 to 7, and like reference numerals have been used for like parts as appropriate.

As in the first embodiment, the first or leg extension/leg curl arm 116 is pivoted to the main frame for rotation about axis 44 at or adjacent its upper end, and has leg engaging roller pads 46 mounted at a position below the first pivot axis 44. Arm 116 has a forwardly curved end portion 120. Unlike the first embodiment, a first pulley 122 is mounted at the top of the first arm 116, coaxial with the first axis 44 between the first arm 116 and the main frame. A second pulley 124 is mounted in a slot 125 at the lower forward end of arm 116 and coaxial with the pivotal axis 50 between the first arm and second or leg press arm 114. The second or leg press arm 114 is longer in this embodiment than in the previous embodiments, and the pulley 72 located at the upper end of leg press arm 48 in the previous embodiments is eliminated, and replaced with a swivel cable attachment 126 at the upper end of arm 114, which is best illustrated in FIG. 18. The upper end 128 of leg press arm 114 is open as in the previous embodiments to receive the post 54 of foot plates 55, and the foot plates are secured at a selected height by releasable pull pin 56, which is located at a position spaced below the swivel cable attachment 126. As in the first embodiment, a stand off or stop post 60 extends from the rear face of the leg press arm 114 and has a bumper 62 at its free end to engage the front face of the leg extension/leg curl arm 116 when the arm 114 is positioned adjacent arm 116, as in FIGS. 14, 15, 17 and 18.

As in the previous embodiments, details of the various pulleys and parts of the cable path which would normally be hidden behind plates or in the frame structure are revealed for explanation purposes in some of the drawings. The first load bearing cable 112 extends from a floating pulley 128 around a pulley 130 on base support 22, and then follows the same path around pulleys 67,68 on the main frame plates 64 as in the previous embodiments. Instead of passing through a slot in the first arm 116, the cable 112 is then reeved around pulley 122 at the top of the first arm 116, and terminates at swivel cable attachment 126 on the second or leg press arm 114 adjacent its open upper end. The second load bearing cable 115 is reeved around a pulley 132 on the upright frame member 24, then around floating pulley 128 and a lower pulley 134 of dual floating pulley assembly 135 adjacent the upper end of the machine 100. From pulley 134, the cable 115 extends around a pulley 136 on the base support 22, then travels through a slot 138 in the front leg of base support 22 (as seen in FIG. 18) while engaging pulley 139 mounted in slot 138 (see FIGS. 17 and 19) and is reeved around the pulley 124 mounted at the lower forward end of first or leg extension/leg curl arm 116. The second cable 115 can travel on from pulley 124 to provide resistance for other exercises by connecting to additional exercise arms or to hand held attachments via connection 140. Alternatively, pulley 124 could be removed and cable 115 could terminate at the same point in other embodiments.

Figure 14:
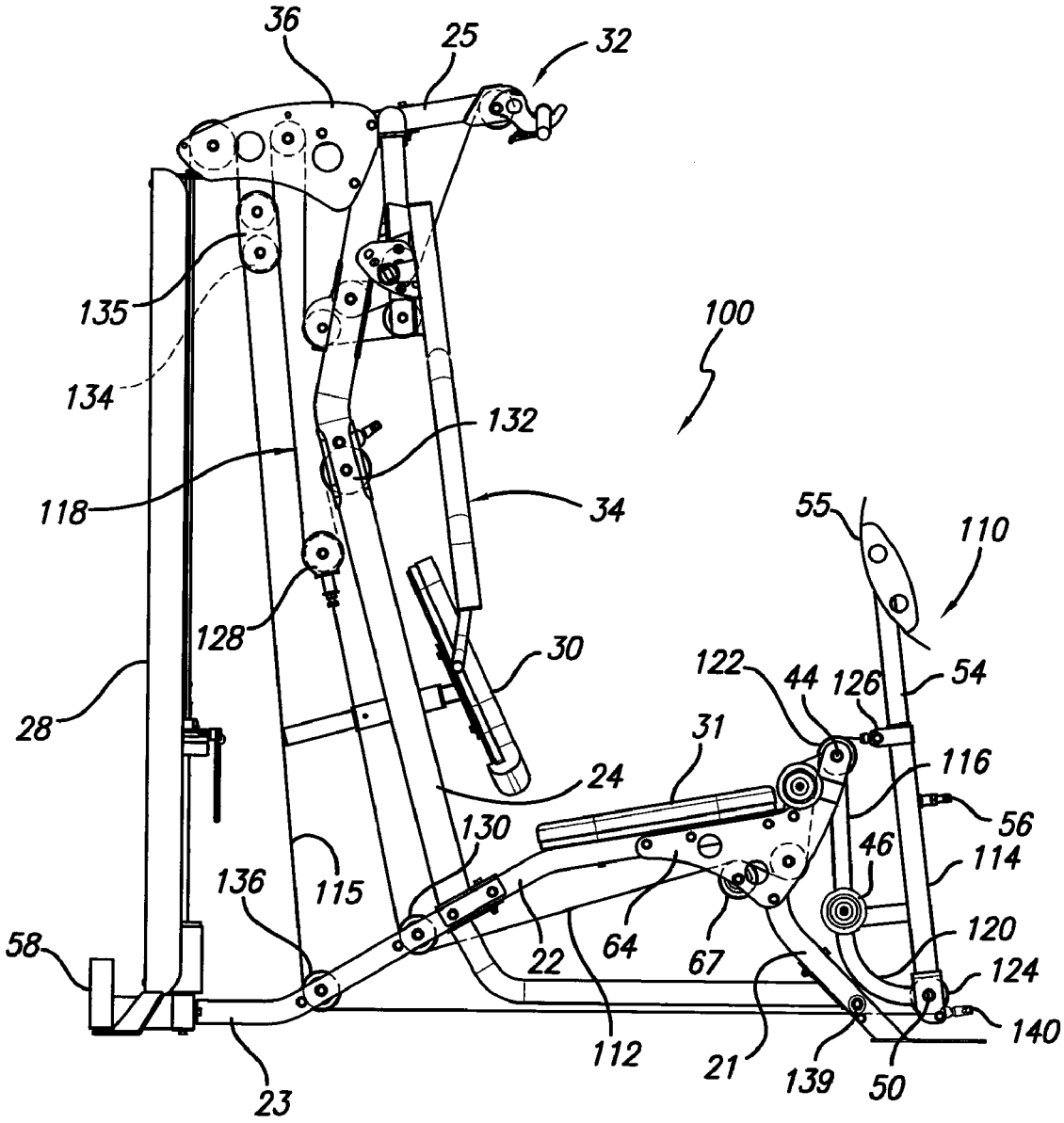
FIG. 14 is a side elevation view of a multi-station exercise machine with a third embodiment of the convertible leg exercise station having a different cabling arrangement from the previous embodiments, illustrating a start position for a leg press exercise.
Figure 15:
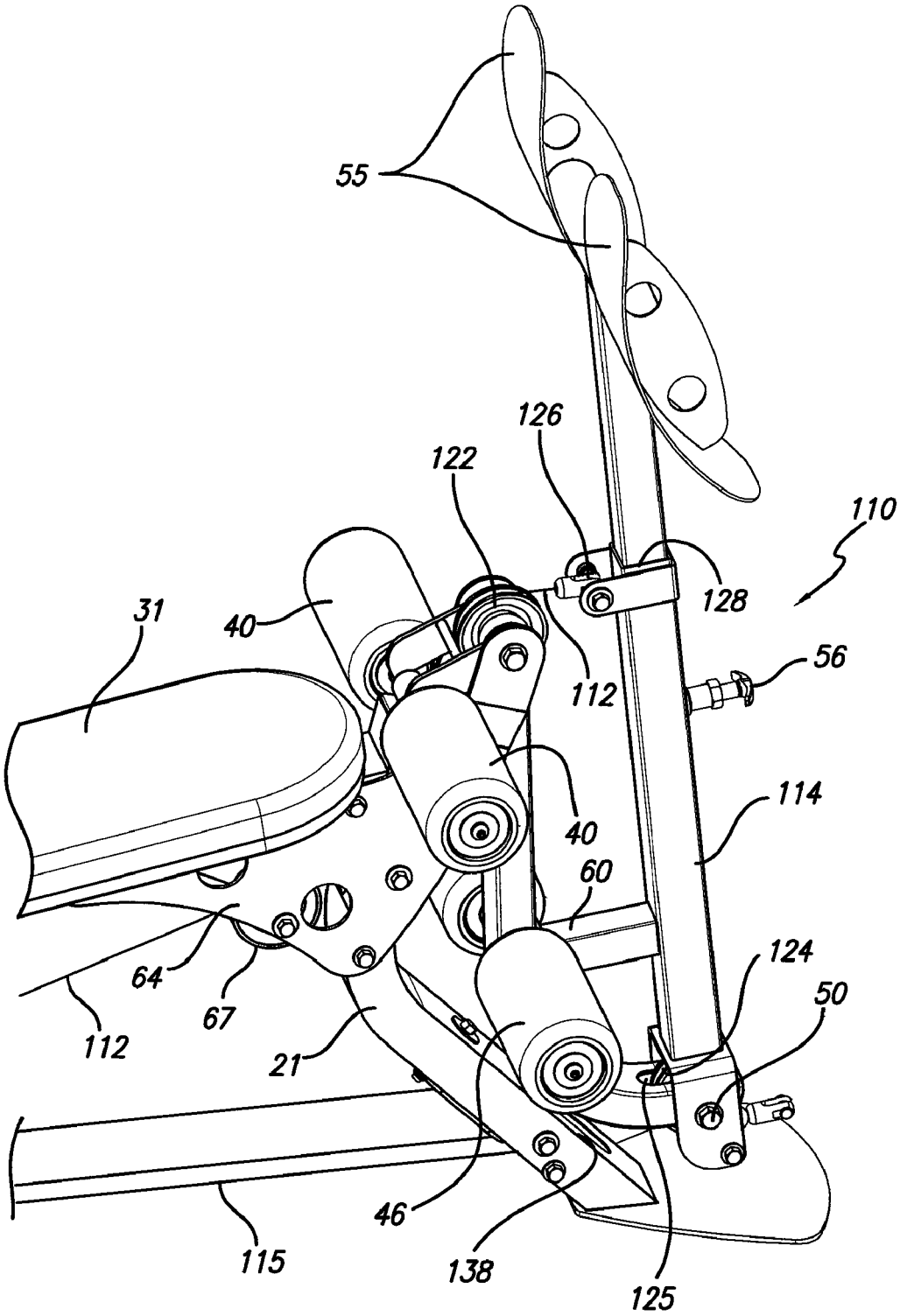
FIG. 15 is an enlarged rear perspective view of the leg exercise station in the start position of FIG. 14.
Figure 16:
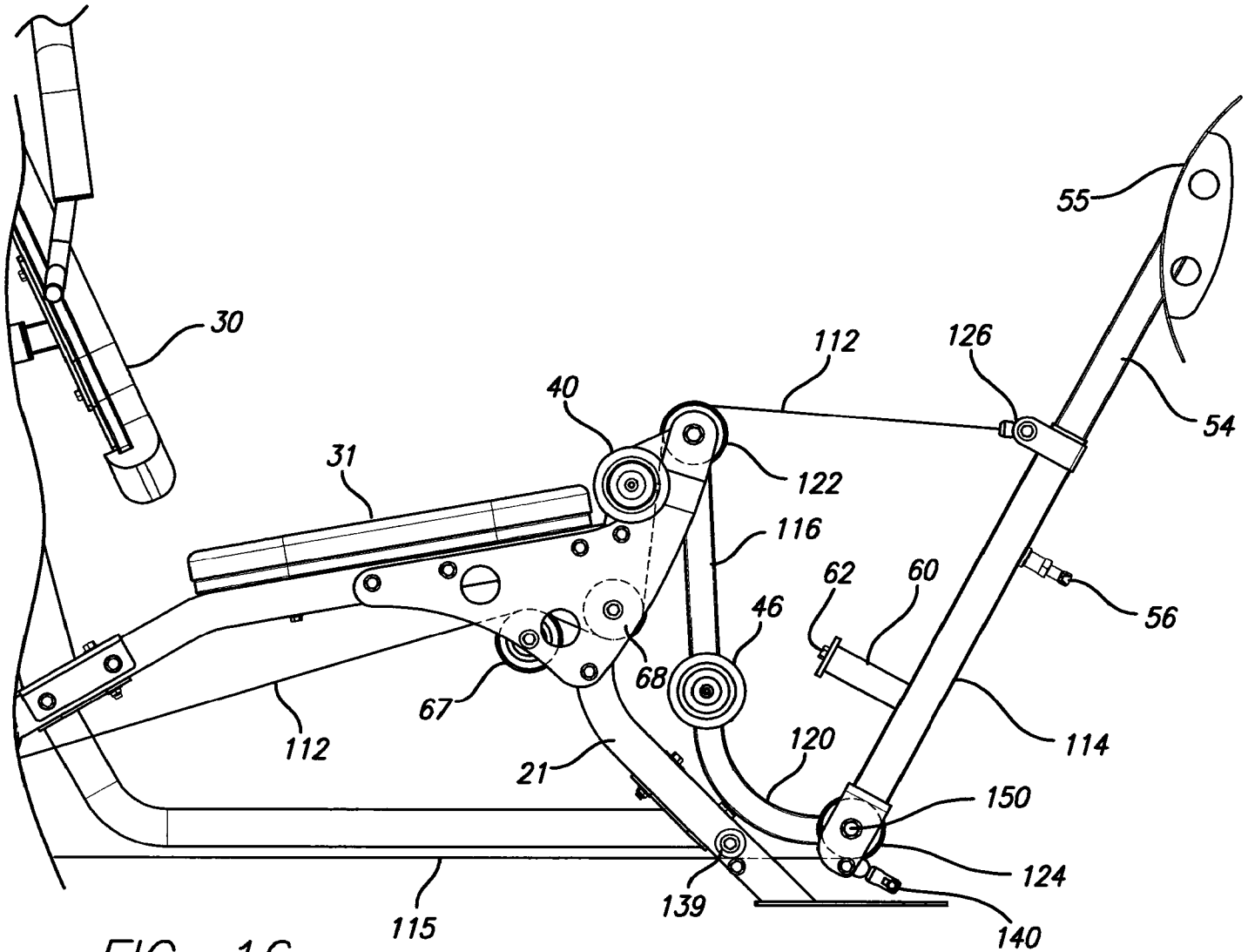
FIG. 16 is a side elevation view of the leg exercise station of FIGS. 14 and 15 in a finish position for a leg press exercise.

FIGS. 14 and 15 illustrate the start position for a leg press exercise using the convertible leg exercise station 110. The post 54 of the foot plate or plates 55 is installed in the upper open end of the leg press arm 114 when the user wishes to perform such exercises. In the start position, the first or leg extension/leg curl arm 116 rests against bumper 47 on the front leg 21 of main frame base support 22, while the rear stop or stand off 60 of the second or leg press arm 114 rests against the front face of the first arm 116. The user sits on seat pad 31 and places their feet against foot plates 55, then pushes the foot plates 55 away from the machine, simultaneously pivoting arm 114 forwardly about the lower pivot axis 50, until the arm reaches the finish position of FIG. 16. It can be understood that different users may finish the leg press exercise in different positions from that of FIG. 16. Resistance for performing the leg press exercise is provided by the first cable 112, and it can be seen that this cable is pulled away from upper pulley 122 as the leg press arm 114 rotates forwards.

Figure 17:
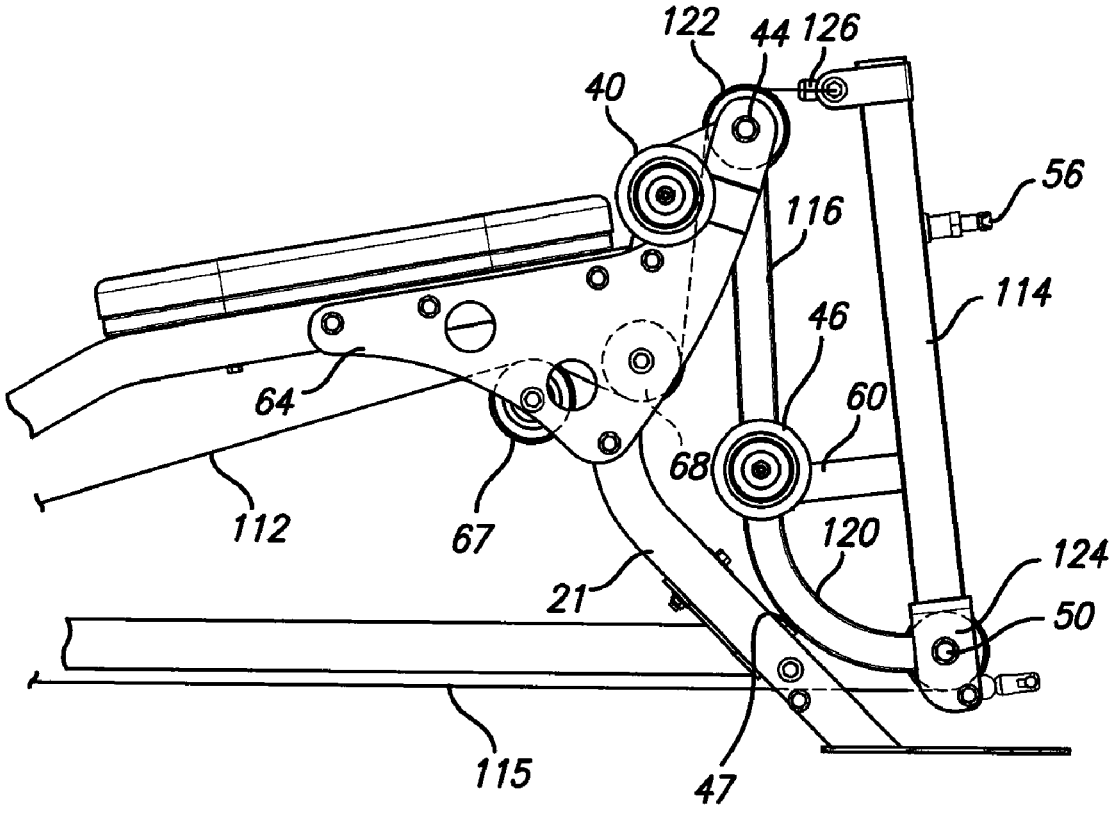
FIG. 17 is a side elevation view of the leg exercise station of FIGS. 14 to 16 in a start position for a leg curl or leg extension exercise.
Figure 18:
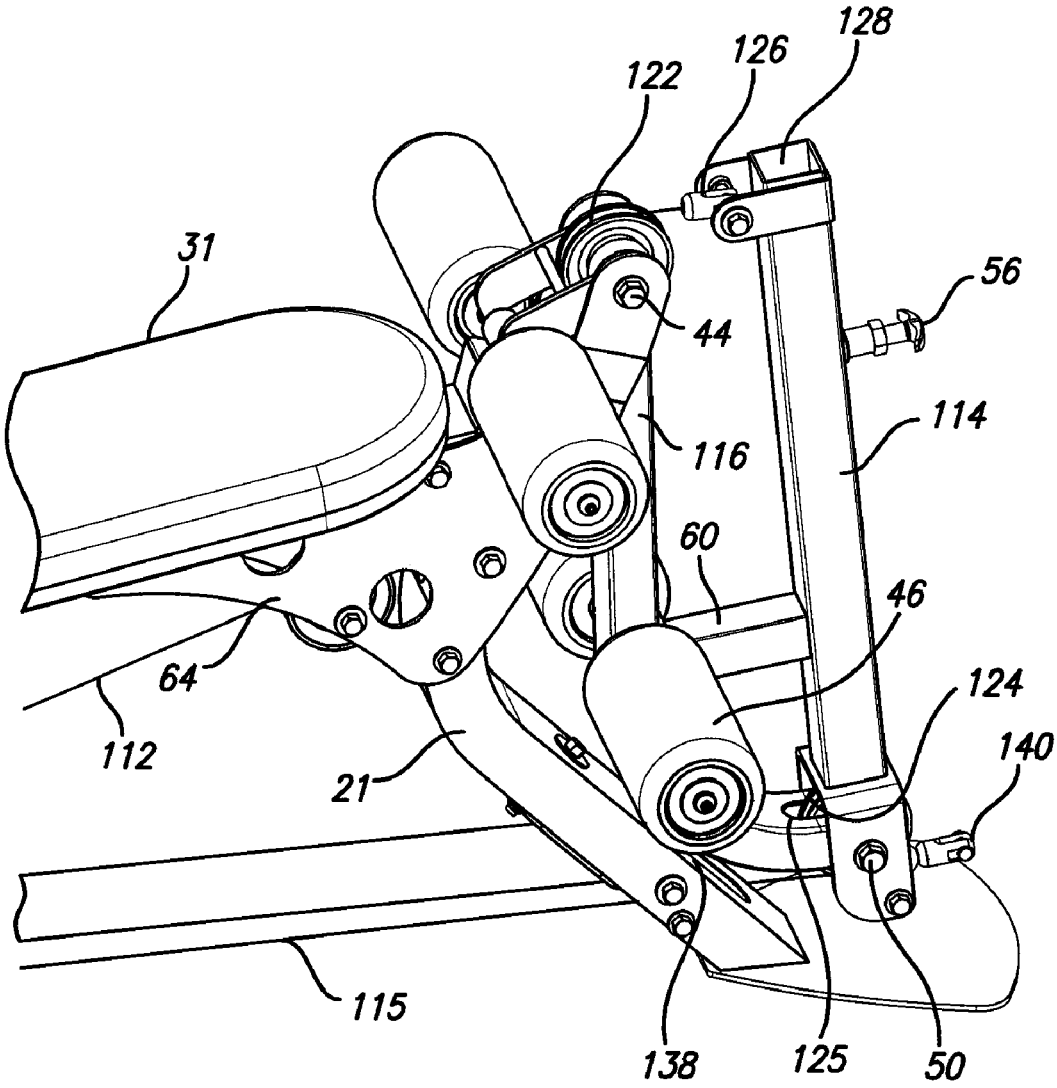
FIG. 18 is a rear perspective view of the leg exercise station in the position of FIG. 17.
Figure 19:
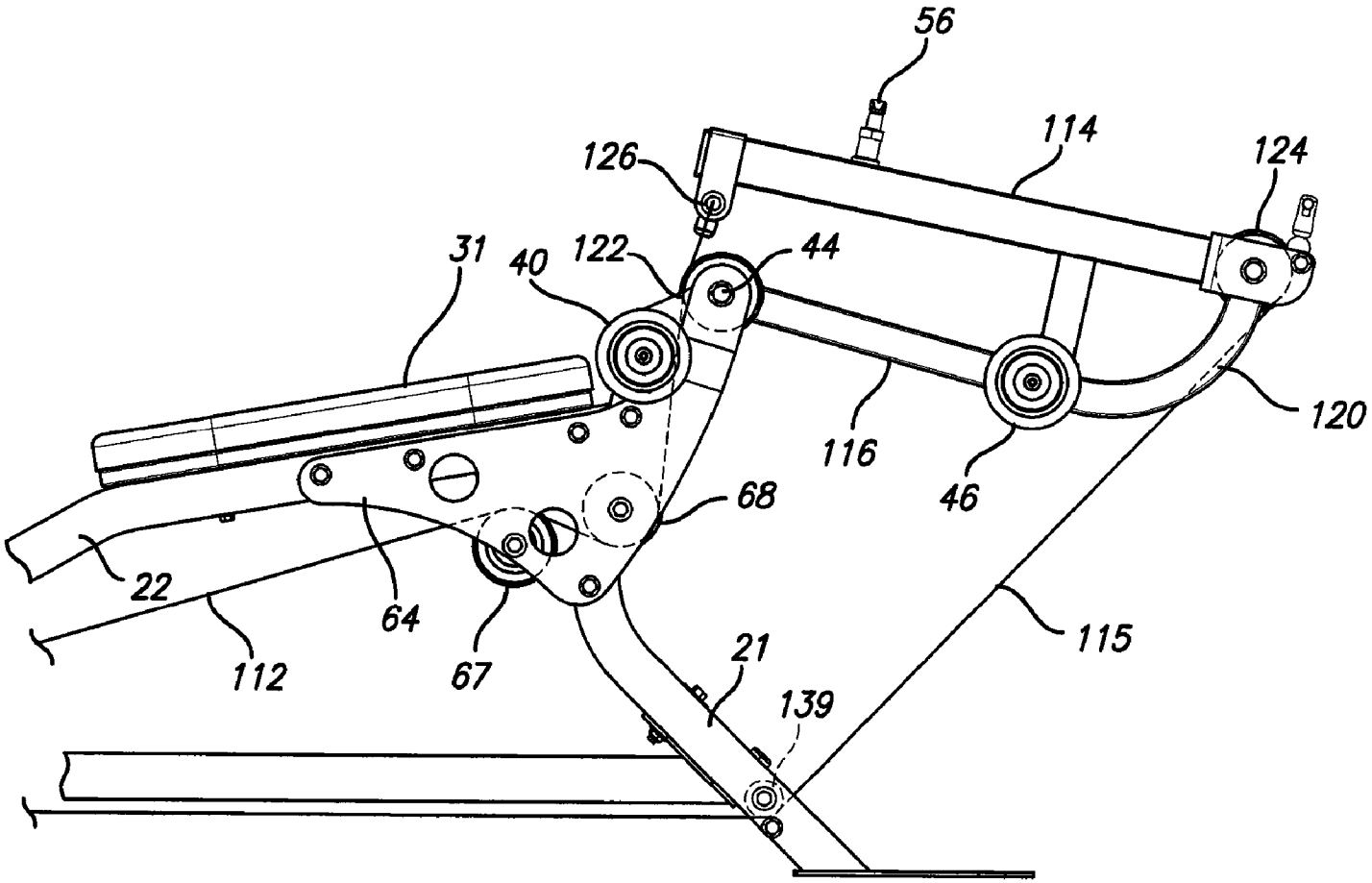
FIG. 19 is a side elevation view of the leg exercise station of FIGS. 14 to 18 illustrating the finish position for a leg curl or leg extension exercise.

FIGS. 17 and 18 illustrate the start position for a leg extension or leg curl exercise using arm 116. The position of arms 116 and 114 is the same as that of FIGS. 14 and 15, but the foot plate is removed from the open upper end of arm 114 and placed in the storage post 58 at the rear end of the machine while these exercises are performed. The user engages lower roller pads 46 from a seated position if performing leg extension exercises, and from a rearwardly facing, standing position if performing leg curls. The roller pads are urged away from the front leg 21 of the frame, rotating the arm 116 along with arm 114 upwardly about pivot 44 until a finish position for the exercise is reached. FIG. 19 illustrates a possible finish position for a leg extension or leg curl exercise. As the arm 116 is moved between the positions of FIGS. 17 and 19, the second cable 115 is extended from the front frame leg 21 to provide exercise resistance, while the first cable 112 is unaffected. The cable 115 wraps around the lower curved section 120 of the arm 116 when the arm is moved to the finish position for the exercise, as seen in FIG. 19. Curved section 120 acts as a guide cam for cable 115 when this exercise is performed.

The block and tackle cabling 118 of FIGS. 14 to 19 may be modified if desired to provide different resistance. For example, the first or leg press cable 112 may be loaded with greater resistance than the second or leg extension/leg curl cable 115, so that a greater amount of resistance is provided for leg press exercises, as in the single cable loading of the previous embodiments. Neither cable needs to be removed or disconnected when a user wishes to switch from one exercise to another. All that is needed is to position the removable foot plate attachment either in the leg press arm or in the storage post, based on the type of exercise to be performed. Each cable is designed to provide resistance to exercise movement of its intended arm only, without affecting resistance to the other arm.

FIGS. 20 to 23 illustrate an exercise machine 150 which is similar to that of the previous embodiment but which has a slightly modified cabling arrangement to the convertible leg exercise station 155. Again, hidden details of the cable and pulley arrangement are revealed in some of the drawings for explanation purposes. The machine of FIGS. 20 to 23 is otherwise identical to the previous embodiment and like reference numbers have been used for like parts as appropriate.

In this embodiment, the second load-bearing cable 115 extends to the pulley 124 at the lower front end of the first exercise arm 116, as in the previous embodiment. However, the attachment of the first load-bearing cable 112 to the leg exercise station 155 is different from that of FIGS. 14 to 19. In this design, the load-bearing cable 112 that provides resistance for the leg press exercise is reeved around a pulley 156 attached to the leg press arm 114 adjacent the open upper end of the arm to reverse in direction, and then attaches to a cable swivel attachment 158 on the front of the leg extension/leg curl arm 116, similar to the arrangement of cable 84 in the embodiment of FIGS. 8 to 13. In all other respects, the convertible leg exercise station 155 is identical to the leg exercise station 110 of FIGS. 14 to 19.

Figure 20:
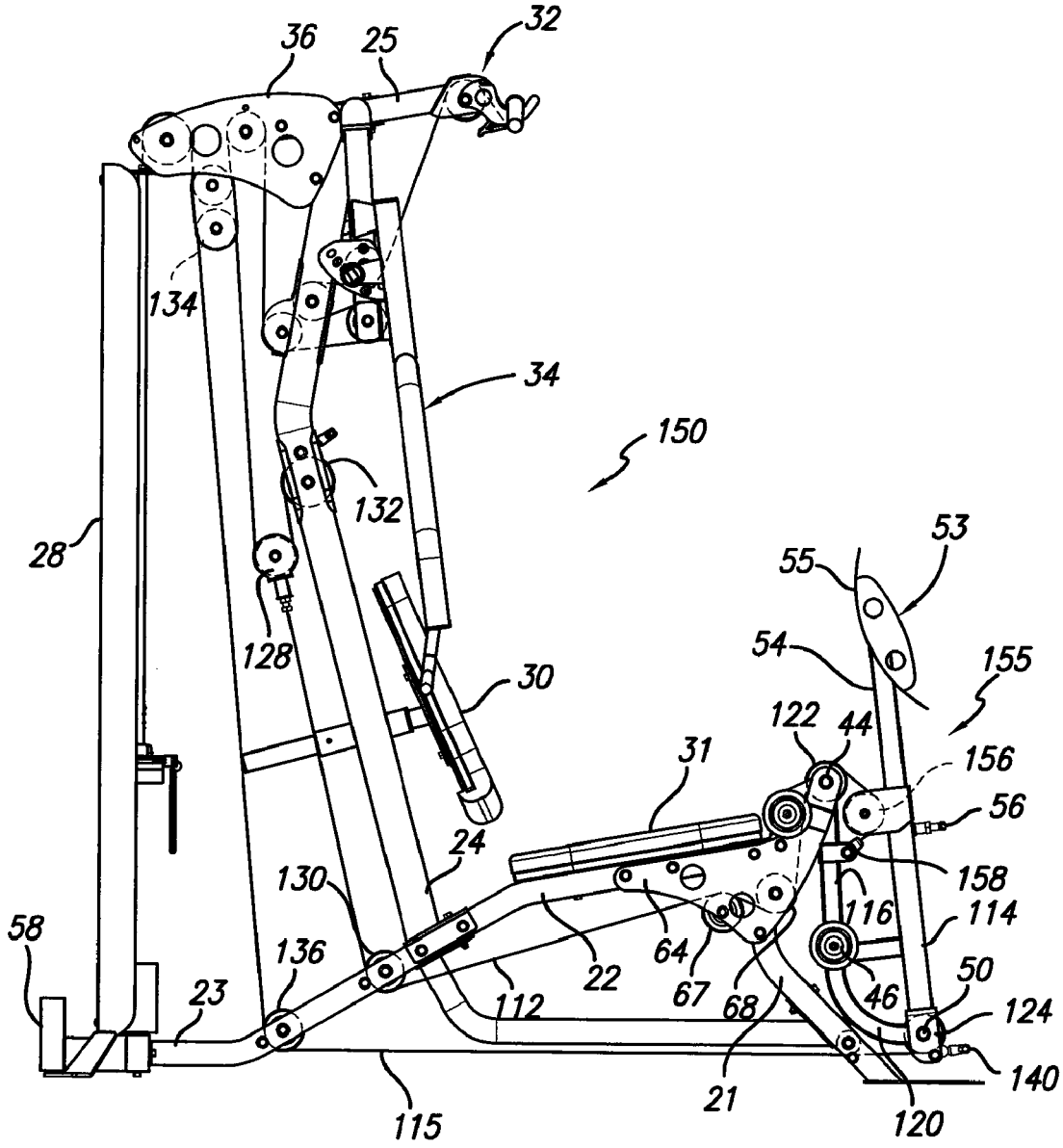
FIG. 20 is a side elevation view of a multi-station exercise machine with a fourth embodiment of the convertible leg exercise station having a modification of the cabling arrangement of FIGS. 14 to 19, with the leg exercise station in a start position for a leg press exercise.
Figure 21:
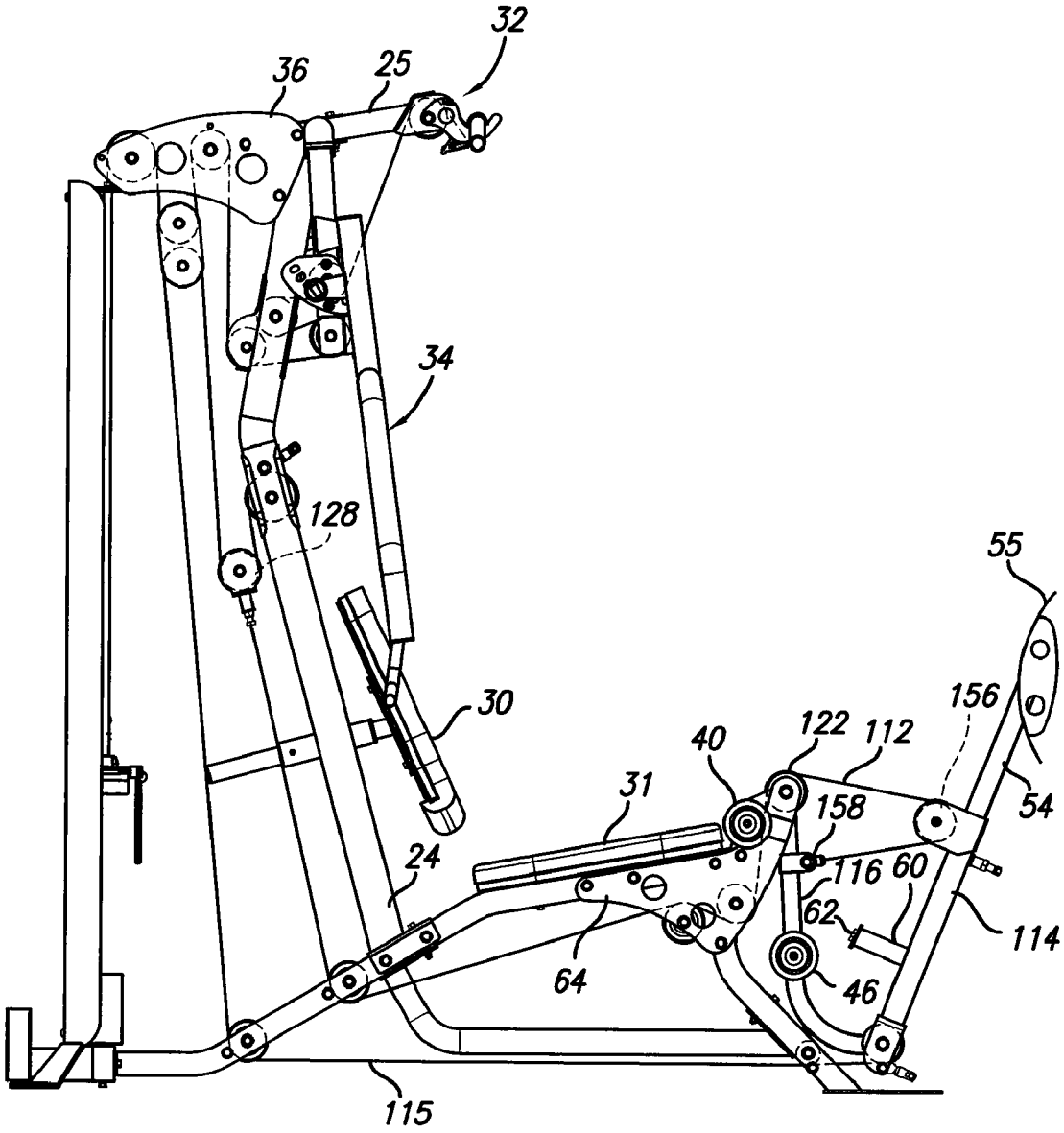
FIG. 21 is a side elevation view of the machine of FIG. 20 with the leg exercise station in a finish position for a leg press exercise.

FIG. 20 illustrates the leg exercise station 155 in a start position for a leg press exercise. In this position, the removable foot plate attachment 53 is engaged in the open upper end of leg press arm 114 and secured at the desired height by pull pin 56. The first arm 116 rests against the bumper 47 on the front leg 21 of the main frame, while the stand off post 60 of the second arm 114 rests against the front of the first arm 116. A seated user engages the foot plates 55 with both feet and pushes forwards, simultaneously rotating the leg press arm 114 forwards about the lower pivot 50. FIG. 21 illustrates a possible finish position for the leg press exercise. This pulls both lengths of cable 112 which extend from pulley 122 around pulley 156 and then back to cable attachment 158 on the first arm 116. It can be seen by comparing FIG. 16 with FIG. 21 that the cable arrangement of FIGS. 20 to 23 provides increased exercise resistance when performing a leg press exercise, due to the double length of cable which is pulled.

Figure 22:
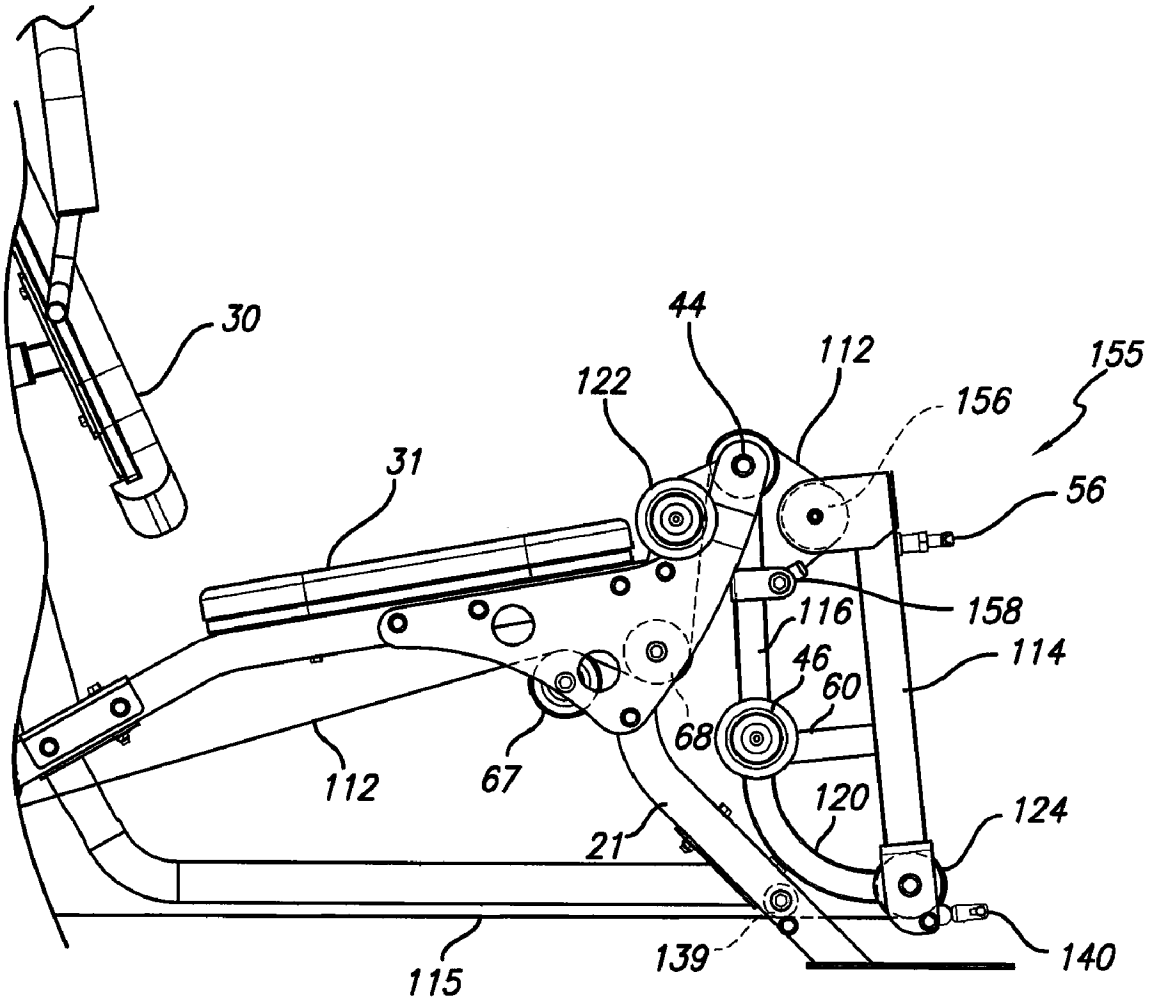
FIG. 22 is a side elevation view of the leg exercise station of FIGS. 20 and 21 in a start position for a leg curl or leg extension exercise.
Figure 23:
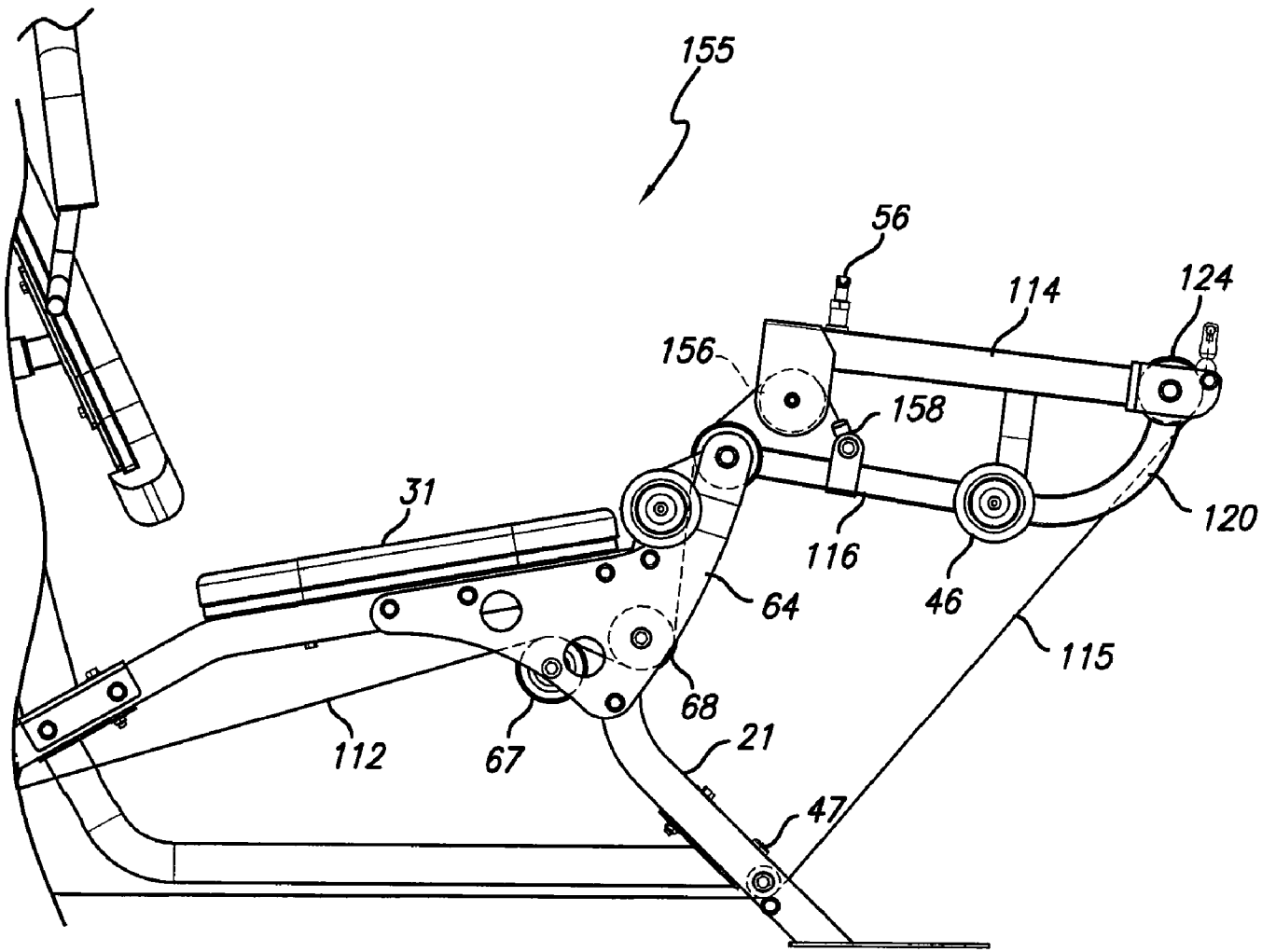
FIG. 23 is a side elevation view similar to FIG. 22 illustrating a finish position for a leg curl or leg extension exercise.

FIG. 22 illustrates the start position for a leg extension and leg curl exercise. The foot plate attachment 53 is removed from the leg press arm when this type of exercise is to be performed, and is placed in the storage post 58 to the rear of the machine during such exercises. The first arm 116 rests against bumper 47 on the frame front leg 21 and the second or leg press arm 114 rests against arm 116 via stand off post 60. As in the previous embodiments, the user either sits on seat pad 31 and engages their legs behind roller pads 46, or stands facing the rear of the machine with the roller pads 46 engaging the rear of their lower legs. Roller pads 46 along with arms 114,116 are then urged away from the front leg 21, so that the arm 116 rotates forwardly about pivot axis 44. FIG. 23 illustrates a possible finish position for a leg extension or leg curl exercise. As the arm 116 is moved between the positions of FIGS. 22 and 23, the second cable 115 is extended from the front frame leg 21 to provide exercise resistance, while the first cable 112 is unaffected. The cable 115 wraps around the lower curved section 120 of the arm 116 when the arm is moved to the finish position for the exercise, as seen in FIG. 23. As in the previous embodiment, curved section 120 acts as a guide cam when this exercise is performed. The amount of exercise resistance provided for this exercise is about the same as in the previous embodiment.

In the dual cable arrangement of the embodiments of FIGS. 14 to 23, the second cable 115 is adapted to continue on from pulley 124 to provide for additional exercises. In alternative embodiments, the first or upper cable 112 may also be adapted to provide for additional exercises. In this alternative, rather than attaching to cable swivel attachment 126 or 158, the cable 112 may extend back through a slot in the first arm 116 and then reeve around an additional pulley on the main frame and continue on to provide additional exercises.

Figure 24:
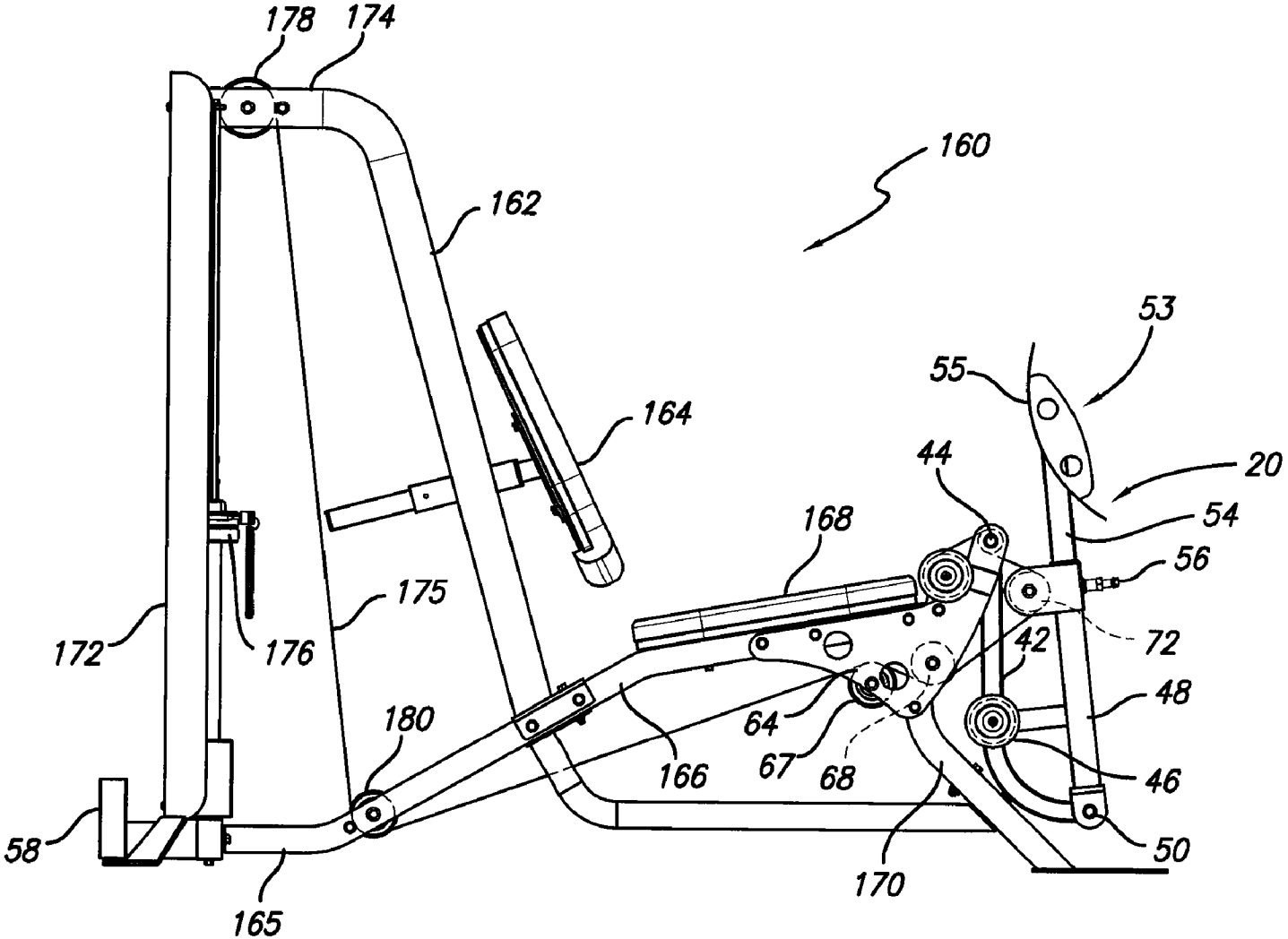
FIG. 24 is a side elevation view of a stand alone leg exercise machine incorporating the leg exercise station of FIGS. 1 to 7.
Figure 25:
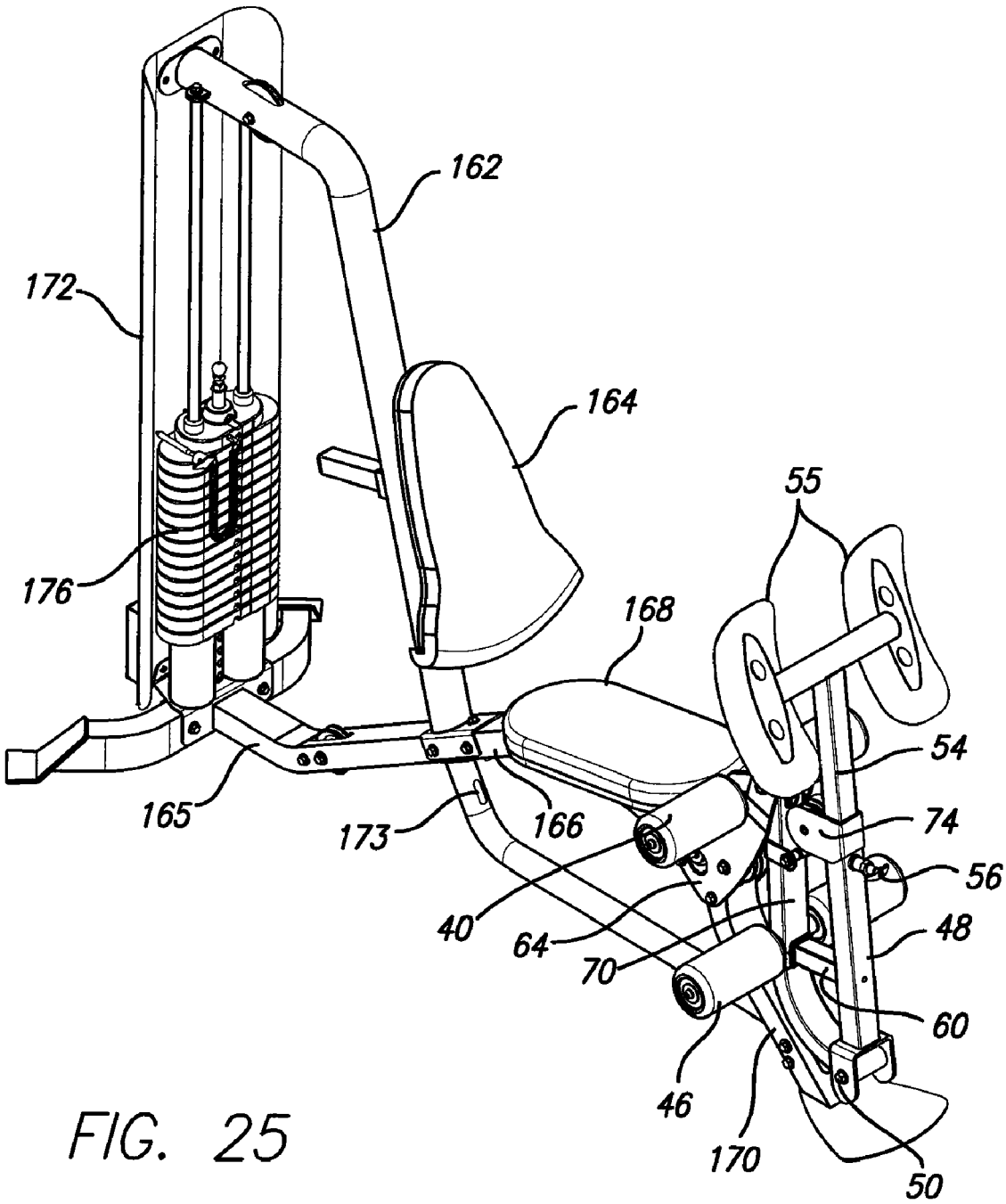
FIG. 25 is a front perspective view of the machine of FIG. 24.

In each of the previous embodiments, the convertible leg exercise station is provided as one of several exercise stations on a multi-function gym. FIGS. 24 and 25 illustrate the leg exercise station 20 of FIG. 1 installed on a stand-alone leg exercise machine 160. The leg exercise station 20 is otherwise identical to that of FIG. 1, and like reference numerals have been used for like parts, as appropriate. It will be understood that any of the other convertible leg exercise stations of FIGS. 8 to 23 may be installed on the leg exercise machine 160 in place of station 20, with suitable adjustment of the load-bearing cable arrangement.

The leg exercise machine 160 has a main frame which is similar to that of the previous embodiments, but with a simpler cable and pulley linkage due to the fact that it has only one exercise station. The frame has a rearwardly inclined, upwardly extending support 162 on which a back pad 164 is mounted, and a base support having a rear, ground or floor-engaging end support 165 and a raised support portion 166 on which seat pad 168 is mounted. An inclined front leg 170 of the base support has a base for engaging the ground or floor. An upright weight stack housing 172 is mounted at the rear of the frame, and has an upper end connected to upwardly extending support 162 by upper member 174.

As in the first embodiment, the leg exercise station 20 has a first exercise arm 42 pivotally mounted on the frame at or close to its upper end for rotation about a first pivot axis 44. Second exercise arm 48 is pivoted to the lower end of first arm 42 at its lower end for rotation about second axis 50. A foot plate attachment 53 is removably mounted in the open upper end of arm 48 and secured at a selected height by pull pin 56. The attachment 53 can be removed and placed in a storage post 58 to the rear of the machine when a user wishes to perform leg extension or leg curl exercises, in exactly the same way as described above in connection with FIGS. 1 to 7.

A load-bearing cable 175 extends from the weight stack 176 in housing 172 around a pulley 178 on the upper frame member 174, a pulley 180 on the frame base support, and through a slot 173 (see FIG. 25) in the lower end of frame upright support 162. The cable is omitted in FIG. 25. The cable 175 then extends around pulleys 67, 68 mounted between plates 64 secured to the frame base support, through a longitudinal slot 70 in arm 42, and around pulley 72 secured to the rear side of the second exercise arm 48, and is attached to the arm 42 to provide resistance to movement of both the first and second arms. The cable 175 is attached to arm 42 by reeving partially around the pivot housing 94, and then anchoring the cable to the housing at a location above the pivot axis 44, as in the embodiment of FIGS. 1 to 7.

It may be understood that the leg exercise station of FIGS. 24 and 25 operates in exactly the same way as illustrated in FIGS. 1 to 7 when carrying out leg press exercise or leg extension or leg curl exercises, with the foot plate attachment 53 being removed for the latter types of exercise.

In each of the above embodiments, the only action needed to convert from a leg press exercise to a leg extension or leg curl exercise is to remove the foot plate attachment 53 from the leg press arm and store it out of the way in the storage post 58 to the rear of the machine. In any of the above embodiments, the foot plate attachment or foot engaging member may alternatively be pivotally attached to the leg press arm for movement between a first, deployed position and a second, folded position for storage when a user performs leg extension or leg curl exercises. A single load-bearing cable can be used to provide exercise resistance to both exercise arms, as in the embodiments of FIGS. 1 to 13, 24 and 25, or two separate load-bearing cables may be used to provide the proper exercise resistance to the respective arms, as in the embodiments of FIGS. 14 to 23. In either case, no removal or adjustment of any cable is required when converting from one type of exercise to another. In the above embodiments, both exercise arms follow a fixed path.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A convertible leg exercise apparatus for performing at least two different types of leg exercise, comprising:

a support frame having a floor or ground-engaging base;

a first leg exercise arm pivotally mounted on the frame for rotation relative to the frame about a first pivot axis, the first leg exercise arm being configured to perform a first leg exercise;

a second leg exercise arm configured to perform a second leg exercise;

a second pivot connection defining a second pivot axis between the second leg exercise arm and the first leg exercise arm, the second leg exercise arm rotating about the second pivot axis relative to the first exercise arm to perform the second leg exercise, the second pivot axis being spaced below the first pivot axis;

a foot engaging device associated with the second leg exercise arm for engagement by a user's feet when performing the second leg exercise;

an exercise resistance associated with the exercise arms to provide a resistance when a user performs the first or the second exercise;

the foot engaging device being movably mounted on the second leg exercise arm for movement between a first position when a user is performing leg press exercises and a second, storage position when a user is performing leg extension and leg curl exercises;

wherein the foot engaging device is removably mounted on the second leg exercise arm and is removed from the second leg exercise arm in the second, storage position;

the second leg exercise arm having an open upper end and the foot engaging device having a support post removably mounted in the open upper end of the second leg exercise arm in the first position; and the frame having a rear end and a forward end, and a storage post being located at or close to the rear of the frame for removably receiving the support post of the foot engaging device in the second, storage position.

2. The apparatus of claim 1, wherein the exercise resistance is adapted to provide exercise resistance to rotation of the first exercise arm about the first pivot axis when a user performs the first exercise and to provide exercise resistance to rotation of the second exercise arm about the second pivot axis when the user performs the second exercise.

3. The apparatus of claim 1, wherein each exercise arm follows a fixed path between a rest position and a finish position of a respective exercise.

4. The apparatus of claim 1, wherein the first exercise arm is configured for performing leg extension and leg curl exercises when rotated about the first pivot axis.

5. The apparatus of claim 4, further comprising a leg engaging device on the first exercise arm spaced below the first pivot axis for engagement by a user when performing leg extension and leg curl exercises, whereby the first and second exercise arms are rotated about the first pivot axis away from the frame when a user performs leg extension and leg curl exercises.

6. The apparatus of claim 4, further comprising a leg engaging device on the second exercise arm spaced below the first pivot axis for engagement by a user when performing leg extension and leg curl exercises, whereby the first and second exercise arms are rotated about the first pivot axis away from the frame when a user performs leg extension and leg curl exercises.

7. The apparatus of claim 1, wherein the first and second exercise arms have a height approximately the same as the height of the first pivot axis when the foot engaging member is moved to the second position and both exercise arms are in a rest position.

8. The apparatus of claim 1, wherein the height of the foot engaging device above the open end of the second arm is adjustable.

9. The apparatus of claim 1, wherein the second exercise arm has an upper end which is located in the vicinity of the first pivot axis in a rest position.

10. The apparatus of claim 1, wherein the base has a front end and a rear end;

a user support is mounted on the frame and adapted to support a user in a seated position facing the front end of the frame when performing at least one type of leg exercise the first exercise arm has an upper end, the first pivot axis being located approximately at the upper end of the first exercise arm, and the second exercise arm having an upper end which is spaced in front of the upper end of the first exercise arm in the rest position;

the second exercise arm rotating together with the first exercise arm and not rotating about the second pivot axis during performance of the first leg exercise.

11. The apparatus of claim 10, further comprising a pulley mounted at the upper end of the first exercise arm coincident with the first pivot axis, and a cable linking the exercise resistance to the second exercise arm extending at least partially around the pulley and linked to the second exercise arm at a location adjacent the upper end of the second exercise arm.

12. The apparatus of claim 1, further comprising a user support on the support frame for supporting the torso of a user in a user support area above the user support when performing at least leg extension and leg press exercises, the user support having a forward end, and the first pivot axis being located at a position spaced in front of the forward end of the user support.

13. The apparatus of claim 12, wherein the first and second leg exercise arms are spaced from the user support area in a finish position for the first exercise when the foot engaging device is moved to the second, storage position.

14. The apparatus of claim 1, further comprising a resistance transfer mechanism linking both exercise arms to the exercise resistance and requiring no adjustment to convert between the different leg exercises.

15. The apparatus of claim 14, wherein the resistance transfer mechanism comprises at least one cable.

16. The apparatus of claim 15, wherein the resistance transfer mechanism comprises a single cable linked to both exercise arms.

17. The apparatus of claim 15, wherein the resistance transfer mechanism comprises a single cable linked to the second exercise arm and linked to the frame at a location spaced from the second exercise arm.

18. The apparatus as claimed in claim 15, wherein the cable terminates at the exercise arms.

19. The apparatus as claimed in claim 15, further comprising at least one additional exercise device, and the cable extends from the leg exercise arms to the additional exercise device.

20. The apparatus of claim 19, wherein the cable is linked to the first exercise arm at a location after the pulley on the second exercise arm, whereby a single length of cable is pulled when performing the first exercise and a double length of cable is pulled when performing the second exercise.

21. The apparatus of claim 19, wherein the cable is linked to the frame at a location after the pulley on the second exercise arm.

22. The apparatus of claim 15, further comprising a pulley on the second exercise arm, the cable extending around the pulley.

23. The apparatus of claim 15, wherein the resistance transfer mechanism comprises a first cable associated with the first exercise arm and a second cable associated with the second exercise arm.

24. The apparatus of claim 23, wherein the first pivot axis is provided at a location in the vicinity of an upper end of the first exercise arm, and a pulley is mounted coaxially with the first pivot axis, the second cable extending at least partially around the pulley.

25. The apparatus of claim 24, wherein the second cable is coupled to the second exercise arm at a location after the pulley.

26. The apparatus of claim 23, wherein the second pivot axis is provided at a location in the vicinity of the lower ends of the first and second exercise arms and a pulley is mounted coaxially with the second pivot axis.

27. The apparatus of claim 26, wherein the first cable extends at least partially around the pulley at the second pivot axis.

28. The apparatus of claim 1, wherein the second pivot axis is spaced forwardly from the first pivot axis in a rest position of the first and second exercise arms.

29. The apparatus of claim 1, wherein the first exercise arm has a forwardly extending lower end portion which has a forward end spaced forward from the first pivot axis, and the second pivot connection is located on the forwardly extending lower end portion of the first exercise arm.

30. The apparatus of claim 1, wherein the first exercise arm has a forward end spaced forward from the first pivot axis, the second exercise arm has a lower end and the second pivot axis is between the forward end of the first exercise arm and the lower end of the second exercise arm.

31. The apparatus of claim 1, wherein the second exercise arm is substantially straight.

32. The apparatus of claim 1, wherein the frame has a front portion, the first exercise arm and the second exercise arm being located in a rest position when not in use, the first exercise arm having a front face and being located adjacent the front portion of the frame in the rest position, and the second exercise arm being located adjacent and resting against the front face of the first exercise arm in the rest position and when the first exercise is performed.

33. The machine of claim 1, wherein the leg exercise apparatus comprises a single exercise station mounted on the frame.

34. The machine of claim 1, further comprising at least one additional exercise station mounted on the frame and linked to the exercise resistance.

35. The machine of claim 1, further comprising a plurality of additional exercise stations mounted on the frame.

36. The machine of claim 1, wherein the foot engaging device comprises a foot plate and the support post extends downwardly from the foot plate to engage the upper end of the second exercise arm.

37. The machine of claim 36, wherein the support post is adjustably engaged with the second exercise arm to adjust the vertical height of the foot engaging device.

38. The apparatus of claim 1, further comprising a user engagement device mounted on one of the arms for engagement by a user when performing leg extension and leg curl exercises.

39. The apparatus of claim 38, wherein the user engagement device is mounted on the first exercise arm.

40. The apparatus of claim 38, wherein both the user engagement device and the foot engaging device are mounted on the second exercise arm, the second exercise arm being configured to rotate about the second pivot axis away from the first exercise arm when a user performs a leg press exercise, and the first and second exercise arms being configured to rotate together about the first pivot axis when a user performs a leg extension or leg curl exercise.

41. The apparatus of claim 1, wherein the base has a forward end, and a rear end;

a user support mounted on the frame which is adapted to support a user in a seated position facing the forward end of the frame when performing at least one type of leg exercise;

the first leg exercise arm being configured to perform a leg extension or leg curl exercise;

the second leg exercise arm being configured to perform a leg press exercise; and the second pivot axis being spaced forwardly from the first pivot axis in all positions of the exercise arms.

42. An exercise machine, comprising:

a frame having a base, a rear end, and a forward end, the base having at least one floor-engaging portion;

a user support mounted on the frame at a location spaced above the floor-engaging portion;

a convertible leg exercise station for performing at least two different leg exercises mounted on the frame for access by a user supported by the user support;

an exercise resistance linked to the leg exercise station;

the leg exercise station comprising a first exercise arm for performing at least one first leg exercise, and a second exercise arm for performing a second, different leg exercise;

a first pivot connection which pivotally mounts the first exercise arm on the frame and defines a first pivot axis about which the first exercise arm rotates relative to the frame;

a second pivot connection between the second exercise arm and the first exercise arm which defines a second pivot axis about which the second exercise arm rotates relative to the first exercise arm, the second pivot connection being spaced below the first pivot connection;

a leg engaging device mounted on the leg exercise station for engagement by a user's legs when performing the first leg exercise, and a foot engaging device mounted on the second exercise arm for engagement by a user's feet when performing the second leg exercise;

the second exercise arm having an upper end, and the foot engaging device extending vertically from the upper end of the second exercise arm;

the foot engaging device being movably mounted at the upper end of the second exercise arm for movement between a first vertically extending position when performing the second exercise and a second storage position when performing the first exercise;

the foot engaging device being removably mounted on the second exercise arm and the second storage position being spaced from the leg exercise station; and a storage location at or close to the rear of the frame for storing the foot engaging device when removed from the second exercise arm.

43. The machine of claim 42, wherein the foot and leg engaging devices are separate and independent whereby the user engages only one of the engaging devices during performance of the respective exercises; and the first leg exercise comprises a leg extension or a leg curl exercise, and the second leg exercise comprises a leg press exercise.

44. The machine of claim 42, further comprising a resistance transfer mechanism linking the exercise resistance to the leg exercise station.

45. The machine of claim 44, wherein the resistance transfer mechanism comprises a cable and pulley linkage.

46. The machine of claim 45, wherein the cable and pulley linkage includes at least one cable extending to the leg exercise station.

47. The machine of claim 46, wherein the cable and pulley linkage includes a single load-bearing cable extending to the leg exercise station for providing exercise resistance for all exercises performed at the station.

48. The machine of claim 46, wherein the cable and pulley linkage includes a first load-bearing cable extending to the leg exercise station for providing a first exercise resistance for the first leg exercise and a second load-bearing cable extending to the leg exercise station for providing a second exercise resistance for the second leg exercise.

49. The machine of claim 48, wherein no adjustment of the first and second load-bearing cables is required for performing either leg exercise.

50. The machine of claim 44, wherein the resistance transfer mechanism at the leg exercise station comprises a single movable pulley and a single cable.

51. The machine of claim 50, wherein the single movable pulley is mounted on the second exercise arm and the cable extends at least partially around the single movable pulley.

52. The machine of claim 51, wherein the cable extends from the single movable pulley to the first exercise arm.

53. The machine of claim 51, wherein the cable extends from the single movable pulley to the frame.

54. The machine of claim 44, wherein the resistance transfer mechanism is configured to provide a first adjustable exercise resistance for the first leg exercise and a second adjustable exercise resistance for the second leg exercise, the second exercise resistance being greater than the first exercise resistance.

55. The machine of claim 42, wherein the first exercise arm comprises a leg extension/leg curl arm configured for performing leg extension and leg curl exercises and the second exercise arm comprises a leg press arm configured for performing leg press exercises, the foot engaging device being movably mounted on the leg press arm.

* * * * *